US008902117B2

(12) United States Patent
Ohno et al.

(10) Patent No.: US 8,902,117 B2
(45) Date of Patent: Dec. 2, 2014

(54) ANTENNA APPARATUS INCLUDING DIPOLE ANTENNA AND PARASITIC ELEMENT ARRAYS FOR FORMING PSEUDO-SLOT OPENINGS

(71) Applicant: Panasonic Corporation, Osaka (JP)

(72) Inventors: Takeshi Ohno, Osaka (JP); Sotaro Shinkai, Osaka (JP)

(73) Assignee: Panasonic Corporation, Osaka (JP)

( * ) Notice: Subject to any disclaimer, the term of this patent is extended or adjusted under 35 U.S.C. 154(b) by 253 days.

(21) Appl. No.: 13/645,835

(22) Filed: Oct. 5, 2012

(65) Prior Publication Data

US 2013/0027268 A1 Jan. 31, 2013

Related U.S. Application Data

(63) Continuation of application No. PCT/JP2012/001026, filed on Feb. 16, 2012.

(30) Foreign Application Priority Data

Jun. 2, 2011 (JP) ..... 2011-123934

(51) Int. Cl.
*H01Q 9/30* (2006.01)
*H01Q 9/28* (2006.01)
*H01Q 19/30* (2006.01)

(52) U.S. Cl.
CPC ..... *H01Q 9/285* (2013.01); *H01Q 19/30* (2013.01)
USPC ..... 343/819; 343/818; 343/795

(58) Field of Classification Search
CPC ..... H01Q 9/16; H01Q 9/28; H01Q 9/285; H01Q 19/30; H01Q 21/06
USPC ..... 343/817, 818, 819, 795, 700 MS
See application file for complete search history.

(56) References Cited

U.S. PATENT DOCUMENTS 4,114,163 A * 9/1978 Borowick ..... 343/815
6,281,843 B1 8/2001 Evtioushkine et al.
6,326,922 B1 * 12/2001 Hegendoerfer ..... 343/700 MS
6,529,170 B1 * 3/2003 Nishizawa et al. ..... 343/795

(Continued)

FOREIGN PATENT DOCUMENTS

JP 2001-320229 11/2001
JP 2008-283251 11/2008

(Continued)

OTHER PUBLICATIONS

International Preliminary Report on Patentability and Written Opinion of the International Searching Authority issued Dec. 12, 2013 in International (PCT) Application No. PCT/JP2012/001026.

*Primary Examiner* — Hoang V Nguyen
(74) *Attorney, Agent, or Firm* — Wenderoth, Lind & Ponack, L.L.P.

(57) ABSTRACT

In each parasitic element array, each of parasitic elements has a strip shape substantially parallel to a longitudinal direction of a dipole antenna, and the parasitic elements are formed at predetermined intervals. For example, the interval is set to be equal to or smaller than ⅛ of a wavelength λ of a high-frequency signal to be fed to a feeder line. The parasitic element arrays are arranged so as to form a plurality of pseudo-slot openings that allow a radio wave from the dipole antenna to propagate therethrough as magnetic currents.

10 Claims, 20 Drawing Sheets

(56) References Cited

U.S. PATENT DOCUMENTS

| | | | | |
|---|---|---|---|---|
| 7,324,059 | B2 * | 1/2008 | Lee et al. | 343/795 |
| 7,642,981 | B2 | 1/2010 | Kanno et al. | |
| 2001/0017603 | A1 | 8/2001 | Teshirogi et al. | |
| 2009/0046019 | A1 | 2/2009 | Sato | |
| 2009/0195460 | A1 | 8/2009 | Kanno | |
| 2009/0207088 | A1 | 8/2009 | Sato et al. | |
| 2010/0117891 | A1 | 5/2010 | Utagawa et al. | |

FOREIGN PATENT DOCUMENTS

| | | |
|---|---|---|
| JP | 2009-5086 | 1/2009 |
| JP | 2011-3972 | 1/2011 |
| WO | 2008/120826 | 10/2008 |

* cited by examiner

ANTENNA APPARATUS INCLUDING DIPOLE ANTENNA AND PARASITIC ELEMENT ARRAYS FOR FORMING PSEUDO-SLOT OPENINGS

This is a continuation application of International application No. PCT/JP2012/001026 as filed on Feb. 16, 2012, which claims priority to Japanese patent application No. JP 2011-123934 as filed on Jun. 2, 2011, the contents of which are incorporated herein by reference.

BACKGROUND OF THE INVENTION

1. Field of the Invention

The present disclosure relates to an antenna apparatus including a dipole antenna, and a wireless communication apparatus including the antenna apparatus.

2. Description of the Related Art

Background Art

A slot antenna has been known as an end-fire antenna according to a prior art. The slot antenna apparatus has a slot, which is formed at an edge of a ground conductor formed on a top surface of a dielectric substrate to intersect the edge, and a feeder line, which is formed on a reverse side of the dielectric substrate to intersect the slot. The feeder line is electromagnetically coupled to the slot, and a high-frequency signal transmitted via the feeder line excites the slot. In this case, an electric field appearing in the slot is guided along the slot in an edge direction of the dielectric substrate, and is radiated in an end-fire direction.

Most end-fire antennas are traveling-wave antennas, and therefore, it is generally easy to achieve a wide band. For example, in Patent Document 1, the band of a slot antenna is widened by devising the shape of a feeder line. In addition, there has been known a technique for raising the gain of an end-fire antenna by an antenna having an array structure including a plurality of slots, or by a tapered slot antenna including a tapered slot having a tapered shape (See Patent Document 2). Prior art documents related to the present disclosure are listed below:

Patent Document 1: Japanese Patent Laid-open Publication No. 2008-283251;

Patent Document 2: Japanese Patent Laid-open Publication No. 2009-5086;

Patent Document 3: U.S. Patent Application No. 2009/0195460;

Patent Document 4: U.S. Patent Application No. 2009/0046019;

Patent Document 5: U.S. Patent Application No. 2009/0207088; and

Patent Document 6: U.S. Pat. No. 6,281,843.

However, when a slot antenna that radiates radio waves in an edge direction of a dielectric substrate is applied to radio waves in a very high frequency band such as a millimeter-wave band, the following two problems arise. First of all, there is such a problem that it is difficult to form a feed portion for feeding to a slot to be small according to the wavelength of radio waves in the millimeter-wave band, by a general etching process of a printed wiring substrate. In addition, there is such a problem that loss of a ground current flowing along the slot becomes relatively large. Since the loss of the ground current is directly associated with a reduction in radiation efficiency, this problem cannot be solved even by the above-described antenna having the array structure or the tapered slot antenna.

SUMMARY OF THE INVENTION

It is an object of the present disclosure is to provide an antenna apparatus and a wireless communication apparatus including the antenna apparatus each capable of solving the above-described problems, each having a size smaller than that of the prior art, and having gain characteristics higher than that of the prior art.

According to the first aspect of the present disclosure, there is provided an antenna apparatus including a dielectric substrate having first and second surfaces, a dipole antenna, and at least three first parasitic element arrays. The dipole antenna includes a first feed element formed on the first surface of the dielectric substrate and connected to a feeder line, and a second feed element formed on the second surface of the dielectric substrate and connected to a ground conductor. The dipole antenna has an electrical length of substantially ½ of a wavelength of a high-frequency signal to be radiated. Each of the first parasitic element arrays includes a plurality of first parasitic elements formed on the first surface of the dielectric substrate. In each of the first parasitic element arrays, each of the plurality of first parasitic elements has a strip shape substantially parallel to a longitudinal direction of the dipole antenna, and the plurality of first parasitic elements are arranged at predetermined first intervals so as to be electromagnetically coupled to each other. The at least three first parasitic element arrays are arranged substantially parallel to one another at predetermined second intervals so that each of first pseudo-slot openings is formed between each pair of adjacent first parasitic element arrays. The first pseudo-slot openings allows a radio wave from the dipole antenna to propagate therethrough as magnetic currents.

In the above-described antenna apparatus, the first interval is preferably set to substantially equal to or smaller than ⅛ of the wavelength.

In addition, in the antenna apparatus, each first parasitic element in one of the pair of adjacent first parasitic element arrays is preferably opposed to a corresponding first parasitic element in another first parasitic element array at their respective adjacent ends.

Further, in the above-described antenna apparatus, each first parasitic element in one of the pair of adjacent first parasitic element arrays is preferably arranged so as to be shifted by a predetermined distance in a direction perpendicular to the longitudinal direction of the dipole antenna from a corresponding first parasitic element in another first parasitic element array.

Still further, the above-described antenna apparatus preferably further includes at least three second parasitic element arrays. Each of the second parasitic element arrays includes a plurality of second parasitic elements formed on the second surface of the dielectric substrate. In each of the second parasitic element arrays, each of the plurality of second parasitic elements has a strip shape substantially parallel to the longitudinal direction of the dipole antenna, and the plurality of second parasitic elements are arranged at predetermined third intervals so as to be electromagnetically coupled to each other. The at least three second parasitic element arrays are arranged substantially parallel to one another at predetermined fourth intervals so that each of second pseudo-slot openings is formed between each pair of adjacent second parasitic element arrays. The second pseudo-slot openings allowing the radio wave from the dipole antenna to propagate therethrough as magnetic currents. The dipole antenna further includes a third parasitic element formed on the second surface so as to be opposed to the first feed element, and a fourth parasitic element fog sued on the first surface so as to be opposed to the second feed element.

In addition, in the above-described antenna apparatus, the third interval is preferably set to substantially equal to or smaller than ⅛ of the wavelength.

Further, in the above-described antenna apparatus, an electrical length of the first feed element and an electrical length of the second feed element are preferably set to be different from each other.

Still further, in the above-described antenna apparatus, an electrical length of the first feed element and an electrical length of the second feed element are preferably set to be substantially equal to each other.

In addition, the above-described antenna apparatus preferably further includes at least one parasitic element pair. Each of the at least one parasitic element pair includes two parasitic elements formed on at least one of the first and second surfaces and operates as a reflector. Each of the two parasitic elements has a strip shape and the two parasitic elements are formed in a straight line so as to be opposed to and be electromagnetically coupled to the dipole antenna. The straight line is parallel to the longitudinal direction of the dipole antenna and is located on an opposite side of the dipole antenna from the at least three first parasitic element arrays.

According to the second aspect of the present disclosure, there is provided a wireless communication apparatus including the above-described antenna apparatus.

The antenna apparatus and wireless communication apparatus according to the present disclosure are configured to include at least three first parasitic element arrays each including a plurality of first parasitic elements formed on a first side of a dielectric substrate. In this case, in each of the first parasitic element arrays, each of the plurality of first parasitic elements has a strip shape substantially parallel to the longitudinal direction of the dipole antenna, and the plurality of first parasitic elements are arranged at the predetermined first intervals so as to be electromagnetically coupled to each other. The at least three first parasitic element arrays are arranged substantially parallel to one another at the predetermined second intervals so that the first pseudo-slot openings are formed between each pair of adjacent first parasitic element arrays. The first pseudo-slot openings allow the radio wave from the dipole antenna to propagate therethrough as the magnetic current. Therefore, it is possible to provide an antenna apparatus and a wireless communication apparatus each having a size smaller than that of the prior art and having gain characteristics higher than that of the prior art.

BRIEF DESCRIPTION OF THE DRAWINGS

These and other objects and features of the present disclosure will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
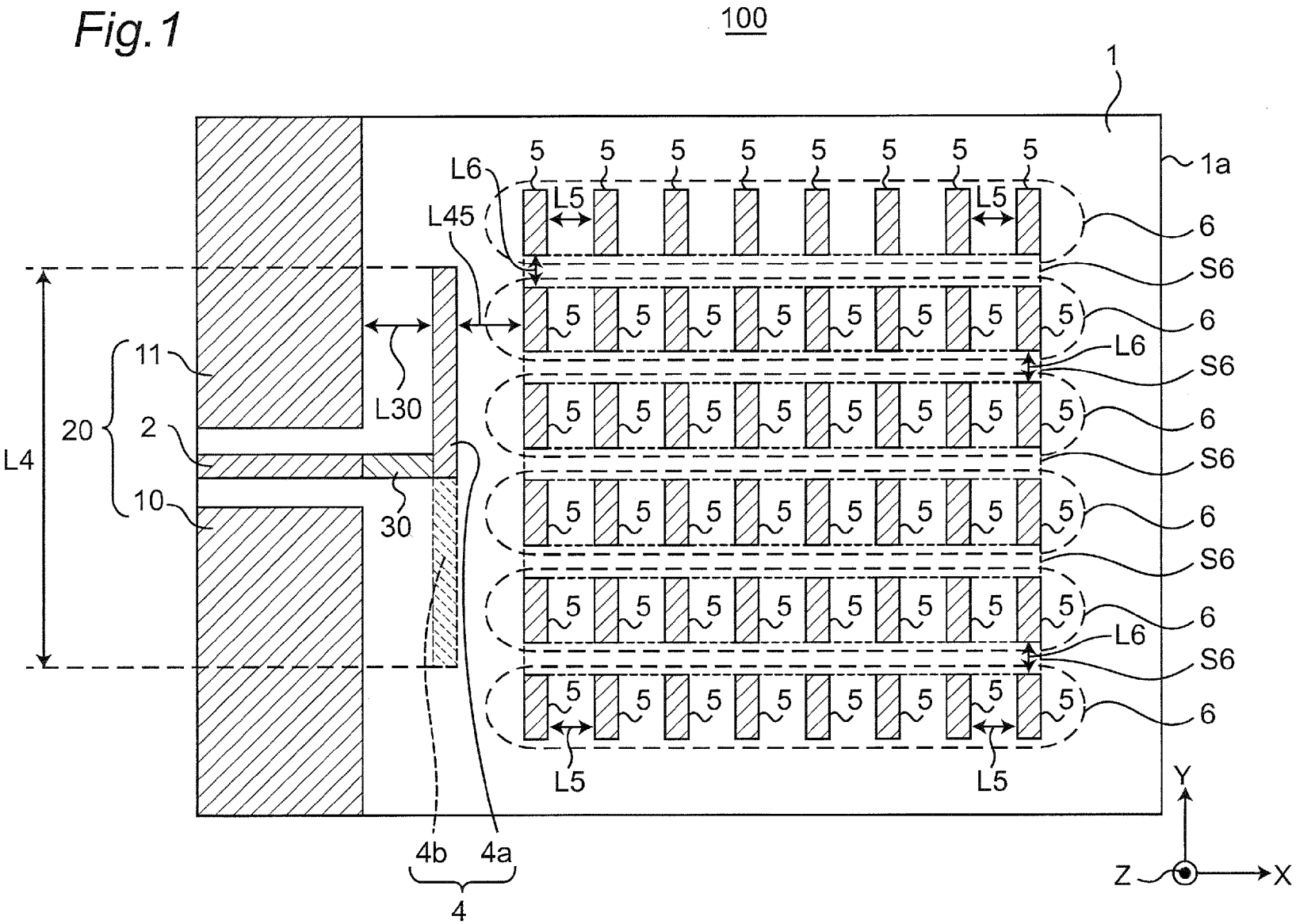
FIG. 1 is a top view of an antenna apparatus 100 according to a first preferred embodiment of the present disclosure.

Preferred embodiments of the present disclosure will be described hereinafter with reference to the drawings. In the preferred embodiments, components similar to each other are denoted by the same reference numerals.

First Preferred Embodiment

Figure 2:
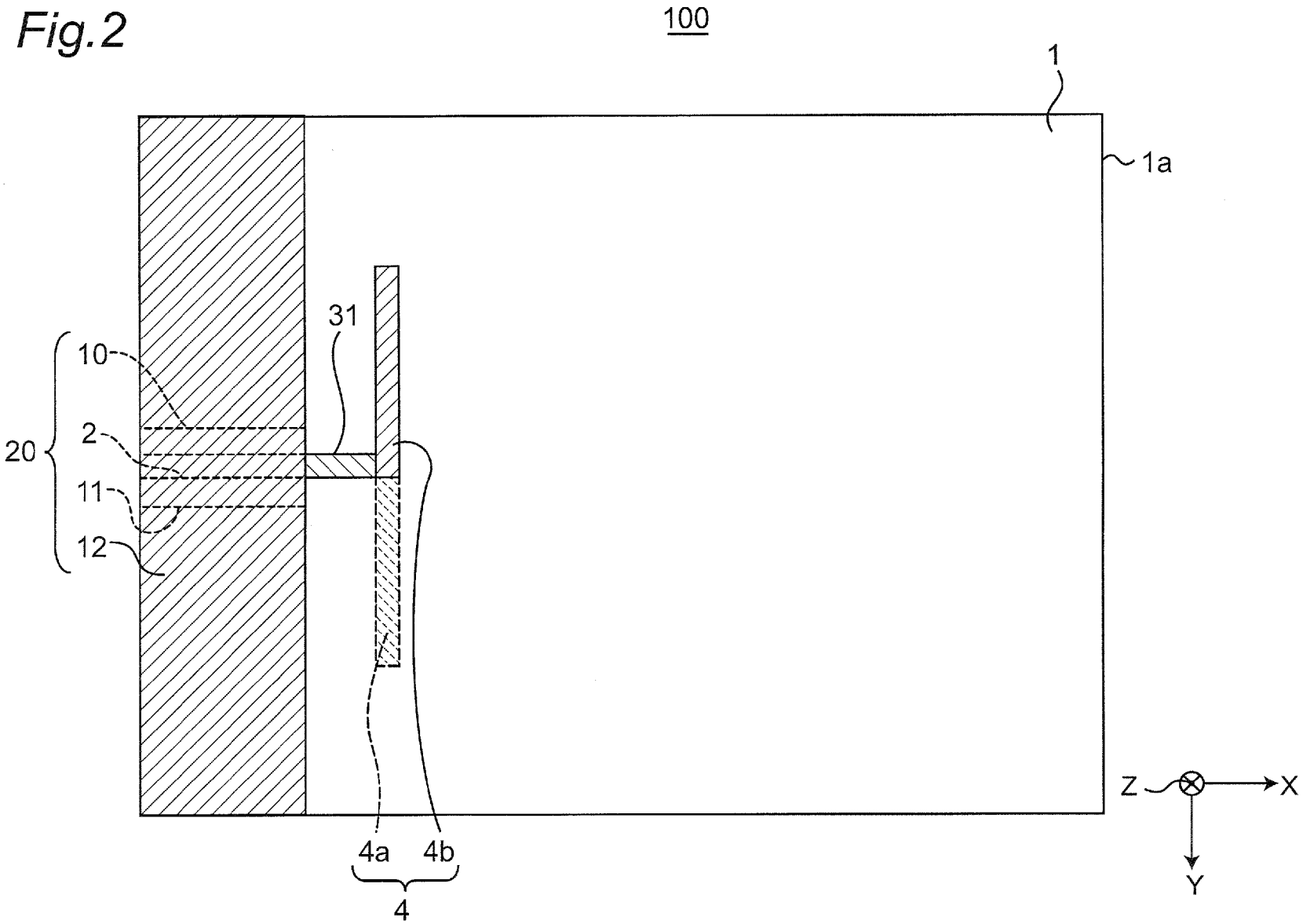
FIG. 2 is a reverse side view of the antenna apparatus 100 of FIG. 1.

FIG. 1 is a top view of an antenna apparatus 100 according to a first preferred embodiment of the present disclosure, and FIG. 2 is a reverse side view of the antenna apparatus 100 of FIG. 1. The antenna apparatus 100 according to the present preferred embodiment is an end-fire antenna apparatus for a wireless communication apparatus that performs wireless communication in a high-frequency band such as a microwave band or a millimeter-wave band.

Referring to FIGS. 1 and 2, the antenna apparatus 100 is configured to include a dielectric substrate 1, ground conductors 10, 11 and 12, strip conductors 2, 30 and 31, and six parasitic element arrays 6 each including eight parasitic elements 5. It is noted that an XYZ coordinate system is defined as shown in FIG. 1 in the present preferred embodiment, the following preferred embodiments and modified preferred embodiment. In this case, in FIG. 1, a right direction is referred to as an X-axis direction, and an upward direction is referred to as a Y-axis direction. In addition, a direction opposite to the X-axis direction is referred to as a -X-axis direction and a direction opposite to the Y-axis direction is referred to as a -Y-axis direction.

Referring to FIG. 1, the dielectric substrate 1 is a glass epoxy substrate, for example. In addition, the ground conductors 10 and 11, the strip conductors 2 and 30, a feed element 4*a*, and the parasitic element arrays 6 are formed on a top surface of the dielectric substrate 1. On the other hand, the ground conductor 12, the strip conductor 31, and a feed element 4*b* are formed on a reverse surface of the dielectric substrate 1. In this case, the ground conductor 12 is formed at a left edge portion of the dielectric substrate 1 of FIG. 1. The strip conductor 2 is formed so as to oppose to the ground conductor 12, and to extend in the X-axis direction from the left edge of the dielectric substrate 1. The ground conductors 10 and 11 are formed on both sides of the strip conductor 2, respectively, so as to oppose to the ground conductor 12. There is a predetermined interval between the ground conductor 10 and the strip conductor 2, and there is a predetermined interval between the ground conductor 11 and the strip conductor 2. It is noted that the ground conductors 10, 11 and 12 are electrically connected to one another. Referring to FIGS. 1 and 2, the ground conductors 10 and 11 and the strip conductor 2, and the ground conductor 12 sandwich the dielectric substrate 1 to configure a grounded coplanar line used as a feeder line 20.

In addition, referring to FIG. 1, the strip conductor 30 has an electrical length L30, has one end connected to a right end of the strip conductor 2 of FIG. 1 and another end, and is formed so as to extend in the X-axis direction. Further, the feed element 4*a* has one end connected to another end of the strip conductor 30, and another end which is an open end. The feed element 4*a* extends in the Y-axis direction from another end of the strip conductor 30. Referring to FIG. 2, the strip conductor 31 has one end connected to the ground conductor 2 and another end connected to one end of the feed element 4*b*. The strip conductor 31 is formed so as to oppose to the strip conductor 30. In addition, the feed element 4*b* has the one end connected to another end of the strip conductor 31 and another end which is an open end. The feed element 4*b* extends in the -Y-axis direction from another end of the strip conductor 30. The feed elements 4*a* and 4*b* formed as described above operate as a half-wave printed dipole antenna (referred to as a dipole antenna hereinafter) 4 having an electrical length L4 from the open end of the feed element 4*a* to the open end of the feed element 4*b*, and radiate radio waves mainly in the X-axis direction. The X-axis direction is also referred to as an end-fire direction hereinafter.

Referring to FIG. 1, each of the parasitic element arrays 6 is configured to include the eight parasitic elements 5 formed on the top surface of the dielectric substrate 1. In this case, each of the parasitic elements 5 has a strip shape extending substantially parallel to a longitudinal direction (Y-axis direction) of the dipole antenna 4. Further, in each of the parasitic element arrays 6, the parasitic elements 5 are arranged at predetermined intervals L5 in a straight line parallel to the X-axis, so as to be electromagnetically coupled to each other.

In addition, referring to FIG. 1, the six parasitic element arrays 6 are formed substantially parallel to one another so that a pair of parasitic element arrays 6 adjacent to each other in the Y-axis direction form a pseudo-slot opening S6 having a predetermined width L6. In the case of FIG. 1, five pseudo-slot openings S6 extending in the X-axis direction are formed by the six parasitic element arrays 6. It is noted that each parasitic element 5 in one of a pair of parasitic element arrays 6 adjacent to each other in the Y-axis direction faces a corresponding parasitic element 5 in another parasitic element array 6 so that the parasitic elements 5 have an interval L6 therebetween at their respective adjacent ends. Therefore, six corresponding parasitic elements in the six parasitic element arrays 6 are arranged in a straight line parallel to the Y-axis.

In this case, the electrical length L4 of the dipole antenna 4 is set to be substantially equal to ½ of the wavelength λ of a high-frequency signal to be fed to the feeder line 20. Therefore, it is possible to radiate radio waves from the dipole antenna 4 efficiently. In addition, the electrical lengths of the respective feed elements 4*a* and 4*b* are set to be substantially equal to each other. Further, the interval L5 is set to, for example, equal to or smaller than λ/8 so that adjacent parasitic elements 5 are electromagnetically coupled to each other. Still further, the width L6 (interval L6) is set to λ/10, for example. Further, an interval L45 between those parasitic elements 5 closest to the dipole antenna 4 and the dipole antenna 4 is set so that the parasitic elements 5 closest to the dipole antenna 4 and the dipole antenna 4 are electromagnetically coupled to each other, and is preferably set to a value equal to the interval L5. The electrical length L30 is set to be equal to the interval L5 for example.

Referring to FIGS. 1 and 2, a high-frequency signal from a high-frequency circuit that outputs a high-frequency signal having frequency components in the high-frequency band such as the microwave band or the millimeter-wave band is transmitted via the feeder line 20 and a transmission line composed of the strip conductors 30 and 31 which are provided to sandwich the dielectric substrate 1, and is fed to the dipole antenna 4 so as to be radiated in the end-fire direction from the dipole antenna 4. On the other hand, in each of the parasitic element arrays 6, the parasitic elements 5 adjacent to each other in the X-axis direction are electromagnetically coupled to each other in the X-axis direction, and each of the parasitic element arrays 6 operates as an electric wall extending in the X-axis direction. Then, the pseudo-slot opening S6 is formed between a pair of the parasitic element arrays 6 adjacent to each other in the Y-axis direction. Therefore, an electric field parallel to the Y-axis direction is generated in each of the pseudo-slot openings S6, and a magnetic current parallel to the X-axis direction flows through each of the pseudo-slot openings S6 accordingly. Therefore, the radio waves radiated from the dipole antenna 4 are transmitted through the top surface of the dielectric substrate 1 along the pseudo-slot openings S6 between the parasitic element arrays 6 so as to be guided in the X-axis direction, and are radiated in the end-fire direction from an edge portion 1*a* (See FIG. 1) on the right side of the dielectric substrate 1. Namely, the antenna apparatus 100 operates with the pseudo-slot openings S6 serving as magnetic current sources. In this case, the radio waves are aligned in phase at the edge portion 1*a* of the dielectric substrate 1, and an equiphase wave plane is generated at the end portion 1*a*. A magnetic current corresponds to an electric current in one-to-one in a predetermined relation, in a manner similar to that of the relation between a magnetic field and an electric field. The electric field is formulated using the magnetic current as a wave source, in a manner similar to that in which the magnetic field is formulated using the electric current as a wave source in the law of Amper. It is noted that each parasitic element 5 in one of a pair of parasitic element arrays 6 adjacent to each other in the Y-axis direction and a corresponding parasitic element 5 in another parasitic element array 6 are not electromagnetically coupled to each other in the Y-axis direction, and thus do not resonate.

As described above, the antenna apparatus 100 is configured to include the dielectric substrate 1, the dipole antenna 4, and the six parasitic element arrays 6. The dipole antenna 4 includes the feed element 4*a*, which is formed on the top surface of the dielectric substrate 1 and is connected to the feeder line 20, and the feed element 4*b*, which is formed on the reverse surface of the dielectric substrate 1 and is connected to the ground conductor 12. The dipole antenna 4 has the electrical length of substantially ½ of the wavelength λ of the high-frequency signal to be radiated. Each of the six parasitic element arrays 6 includes the plurality of parasitic elements 5 formed on the top surface of the dielectric substrate 1. In this case, the antenna apparatus 100 is characterized in that, in each of the parasitic element arrays 6, the plurality of parasitic elements 5 have a strip shape substantially parallel to the longitudinal direction of the dipole antenna 4 and are arranged at the predetermined intervals L5 so as to be electromagnetically coupled to each other, and the six parasitic element arrays 6 are arranged substantially parallel to one another at the predetermined intervals L6 so that the pseudo-slot opening S6 that allows the radio wave from the dipole antenna 4 to propagate therethrough as the magnetic current is formed between each pair of adjacent parasitic element arrays 6.

Therefore, according to the antenna apparatus 100 of the present preferred embodiment, each of the parasitic element arrays 6 operates as an electric wall, and the pseudo-slot opening S6 is formed between two parasitic element arrays 6 adjacent to each other in the Y-axis direction. Namely, since the antenna apparatus 100 has such a configuration in which, for example, a conductor extending in the X-axis direction is cut into the plurality of parasitic elements 5, the length of the conductor is reduced, and this leads to reduced currents flowing along the pseudo-slot openings S6.

In addition, by setting the interval L5 as small as possible, the parasitic elements 5 adjacent to each other in the X-axis direction are intensely electromagnetically coupled to each other via a free space on the top surface of the dielectric substrate 1, and the density of the lines of electric force in the dielectric substrate 1 can be decreased. Therefore, the influence of the dielectric loss in the dielectric substrate 1 can be reduced. Therefore, it is possible to obtain a gain characteristic higher than that of the prior art.

Further, according to the antenna apparatus 100 of the present preferred embodiment, by forming the parasitic elements 5 to be smaller in size, it is possible to reduce currents generated in the parasitic elements 5. In addition, by narrowing the interval L5 between the parasitic elements 5, the dielectric loss in the dielectric substrate 1 can be reduced. Therefore, it is possible to miniaturize the antenna apparatus 100, and to obtain high gain characteristics.

In addition, since equiphase wave plane is generated at the end portion 1*a* of the dielectric substrate 1, a beam width in a vertical plane and a beam width in a horizontal plane can be narrowed than those of the prior art.

Further, since the antenna apparatus 100 operates using the magnetic currents flowing through the pseudo-slot openings S6, the influence of interference between the antenna apparatus 100 and conductors arranged near the antenna apparatus 100, on the gain is relatively small.

Still further, according to the present preferred embodiment, since the feeder line 20 is a grounded coplanar line, the ground conductors 10 and 11 operate as reflectors that reflect radio waves radiated in the -X-axis direction from the dipole antenna 4, in the X-axis direction. Therefore, radio waves from the dipole antenna 4 can be efficiently directed to the parasitic element arrays 6, and this leads to increased gain.

Therefore, the antenna apparatus 100 according to the present preferred embodiment can increase the power efficiency of a wireless communication apparatus that performs communication in the high-frequency band such as the millimeter-wave band, within which a relatively large propagation loss in space occurs. In addition, since the antenna apparatus 100 according to the present preferred embodiment includes the dipole antenna 4, it is relatively easy to realize an antenna apparatus for transmitting and receiving high-frequency signals in a millimeter-wave band, etc.

In the present preferred embodiment, the antenna apparatus 100 includes the six parasitic element arrays 6, however, the present disclosure is not limited this. The antenna apparatus 100 may include three or more parasitic element arrays 6 arranged so as to form a plurality of pseudo-slot openings S6. It is noted that the longer the length in the end-fire direction of each parasitic element array 6 (the larger the number of parasitic elements 5) becomes, the narrower the beam width in the vertical plane (XZ-plane) becomes. In addition, the larger the number of parasitic element arrays 6 becomes, the narrower the beam width in the horizontal plane (XY-plane)

becomes. Namely, the beam widths in the vertical and horizontal planes can be controlled independently by the length and number of the parasitic element arrays 6.

Modified Preferred Embodiment of the First Preferred Embodiment

In the first preferred embodiment, the lengths in the X-axis direction of the respective parasitic element arrays 6 (i.e., the numbers of parasitic elements 5 in the respective parasitic element arrays 6) are the same, however, the present disclosure is not limited this. The lengths in the X-axis direction of the respective parasitic element arrays 6 may be different from one another. In addition, in the first preferred embodiment, in each of the parasitic element arrays 6, the parasitic elements 5 are arranged at equal intervals L5, however, the present disclosure is not limited to this. In each of the parasitic element arrays 6, the parasitic elements 5 may be arranged at unequal intervals so as to be electromagnetically coupled to each other in the X-axis direction. However, it is noted that the maximum value of the intervals between the parasitic elements 5 in each of the parasitic element arrays 6 is preferably equal to or smaller than $\lambda/8$.

Figure 3:
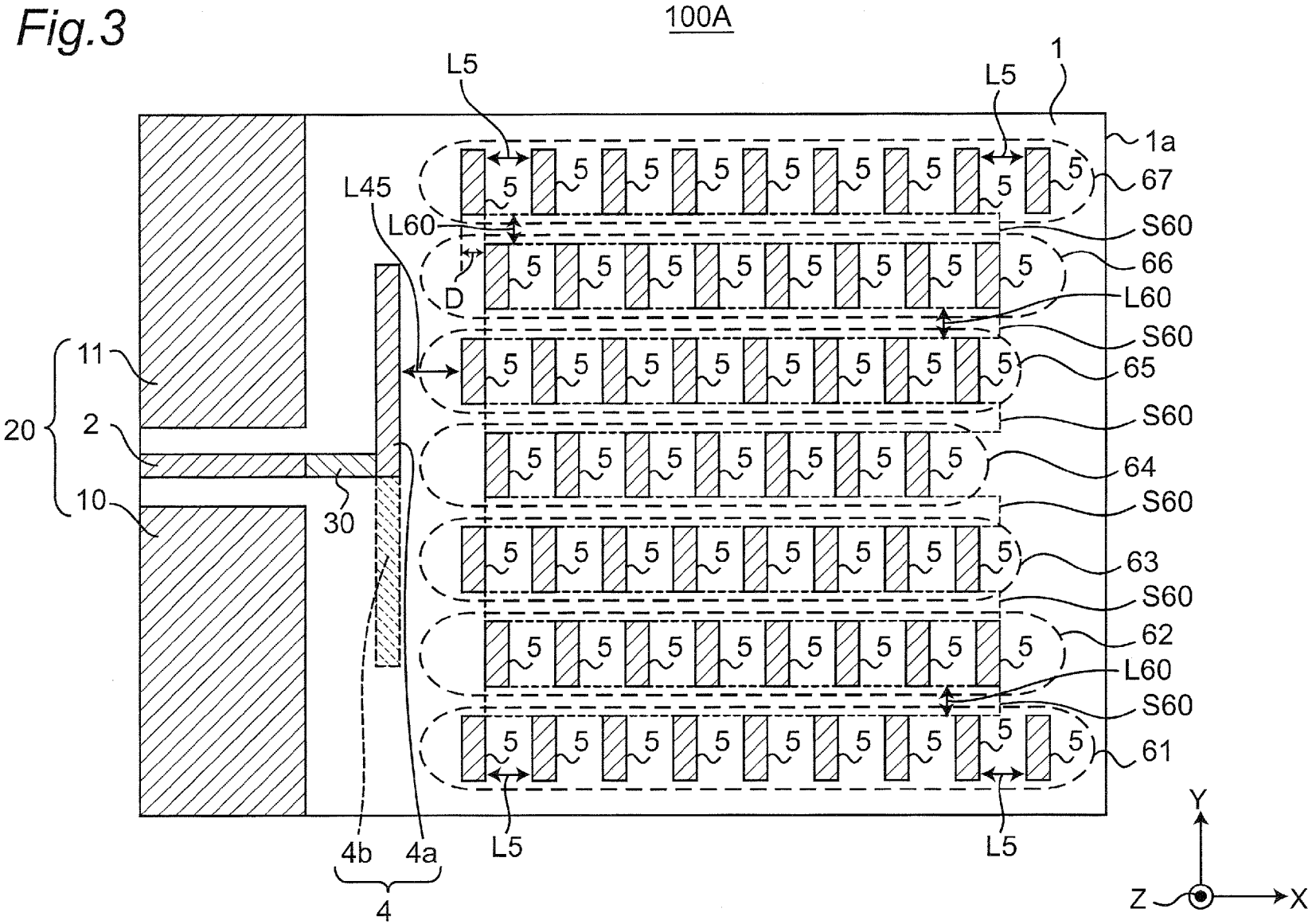
FIG. 3 is a top view of an antenna apparatus 100A according to a modified preferred embodiment of the first preferred embodiment of the present disclosure.
Figure 4:
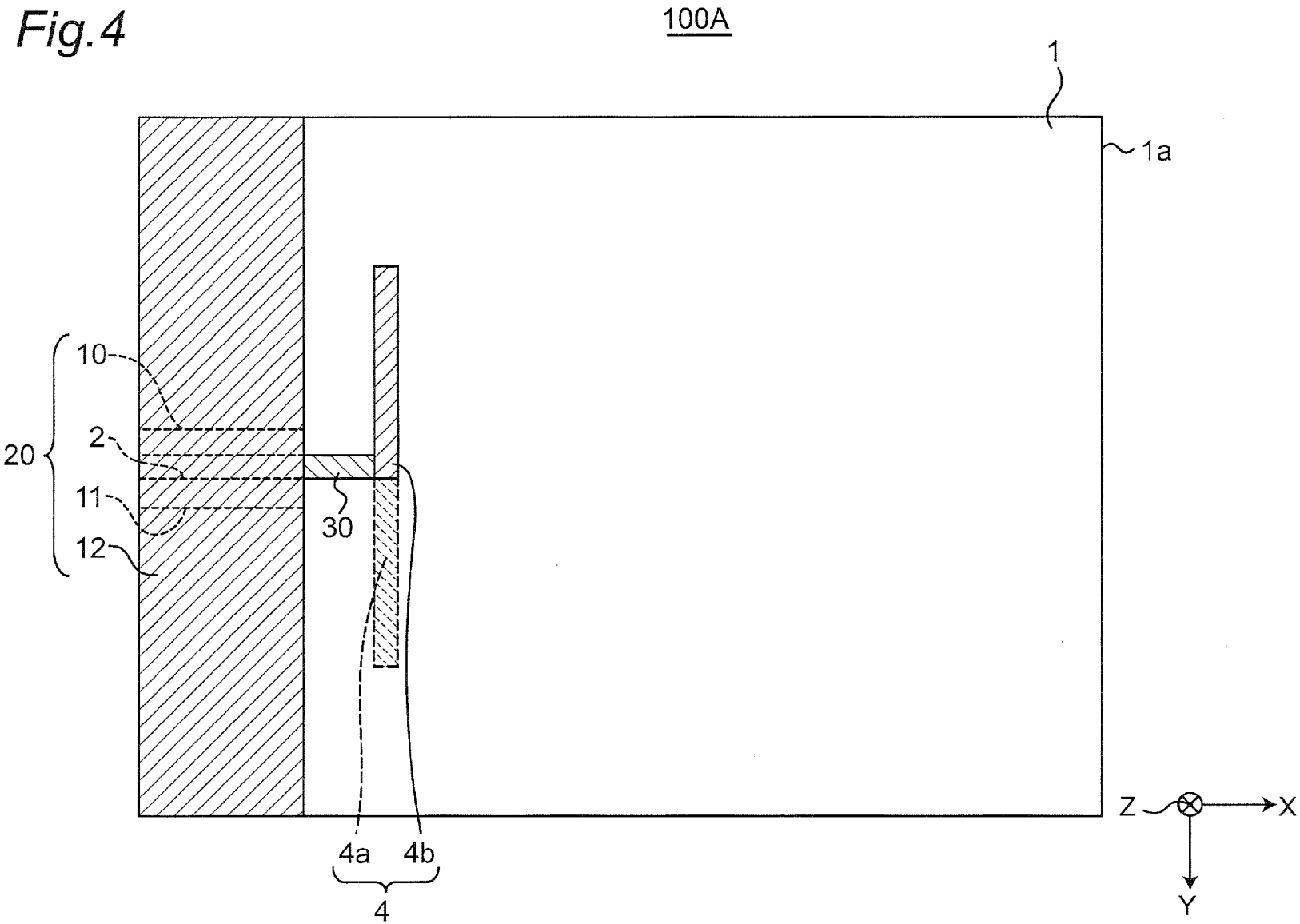
FIG. 4 is a reverse side view of the antenna apparatus 100A of FIG. 3.

FIG. 3 is a top view of an antenna apparatus 100A according to a modified preferred embodiment of the first preferred embodiment of the present disclosure, and FIG. 4 is a reverse side view of the antenna apparatus 100A of FIG. 3. The antenna apparatus 100A is different from the antenna apparatus 100 in that the antenna apparatus 100A includes parasitic element arrays 61 to 67 instead of the six parasitic element arrays 6. In the present modified preferred embodiment, only differences from the first preferred embodiment will be described.

Referring to FIG. 3, the parasitic element arrays 61, 62, 63, 64, 65, 66 and 67 are configured to include 9, 8, 8, 7, 8, 8 and 9 parasitic elements 5, respectively. In each of the parasitic element arrays 61 to 67, the parasitic elements 5 are formed and arranged in a manner similar to that of the parasitic elements 5 in the parasitic element arrays 6 according to the first preferred embodiment. In addition, in FIG. 3, the parasitic element arrays 61, 62, 63, 64, 65, 66 and 67 are formed substantially parallel to one another so that a pair of parasitic element arrays adjacent to each other in the Y-axis direction form a pseudo-slot opening S60 having a predetermined width L60. In the case of FIG. 3, six pseudo-slot openings S60 extending in the X-axis direction are formed by the seven parasitic element arrays 61 to 67.

It is noted that, in the parasitic element arrays 61 to 67, each parasitic element 5 in one of a pair of parasitic element arrays adjacent to each other in the Y-axis direction is arranged so as to be shifted by a predetermined distance D in a direction perpendicular to the longitudinal direction of the dipole antenna 4 from a corresponding parasitic element 5 in another parasitic element array. Further, referring to FIG. 3, the interval L5, the interval L45 and the width L60 are set in the same manners as those of the interval L5, the interval L45 and the width L6 in the first preferred embodiment, respectively.

Referring to FIGS. 3 and 4, the radio waves radiated from the dipole antenna 4 are transmitted through the top surface of the dielectric substrate 1 along the respective pseudo-slot openings S60 between the parasitic element arrays 61 to 67 so as to be guided in the X-axis direction, and are radiated in the end-fire direction from the edge portion 1*a* on the right side of the dielectric substrate 1. The antenna apparatus 100A exhibits advantageous effects the same as those of the antenna apparatus 100 according to the first preferred embodiment.

Second Preferred Embodiment

Figure 5:
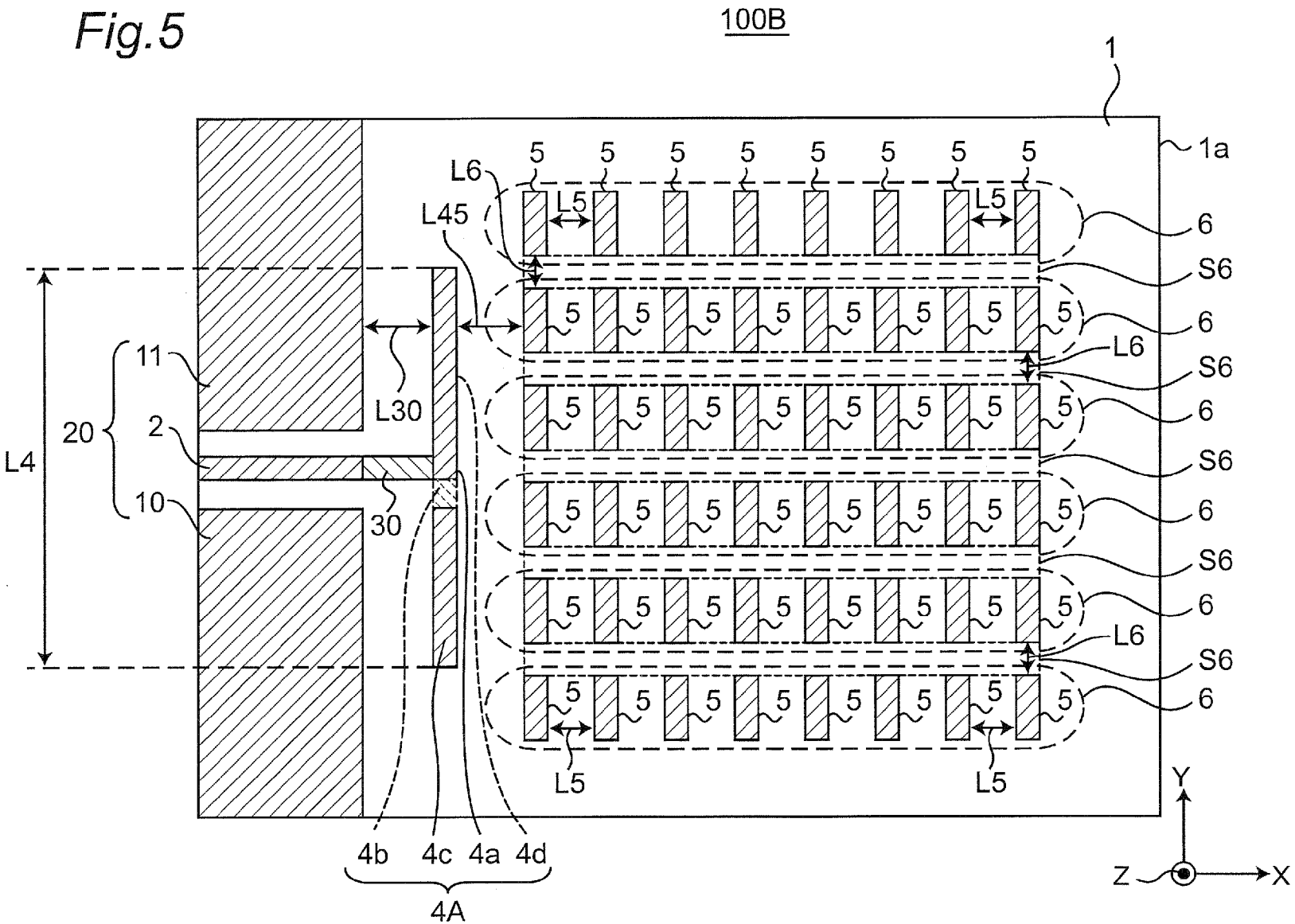
FIG. 5 is a top view of an antenna apparatus 100B according to a second preferred embodiment of the present disclosure.
Figure 6:
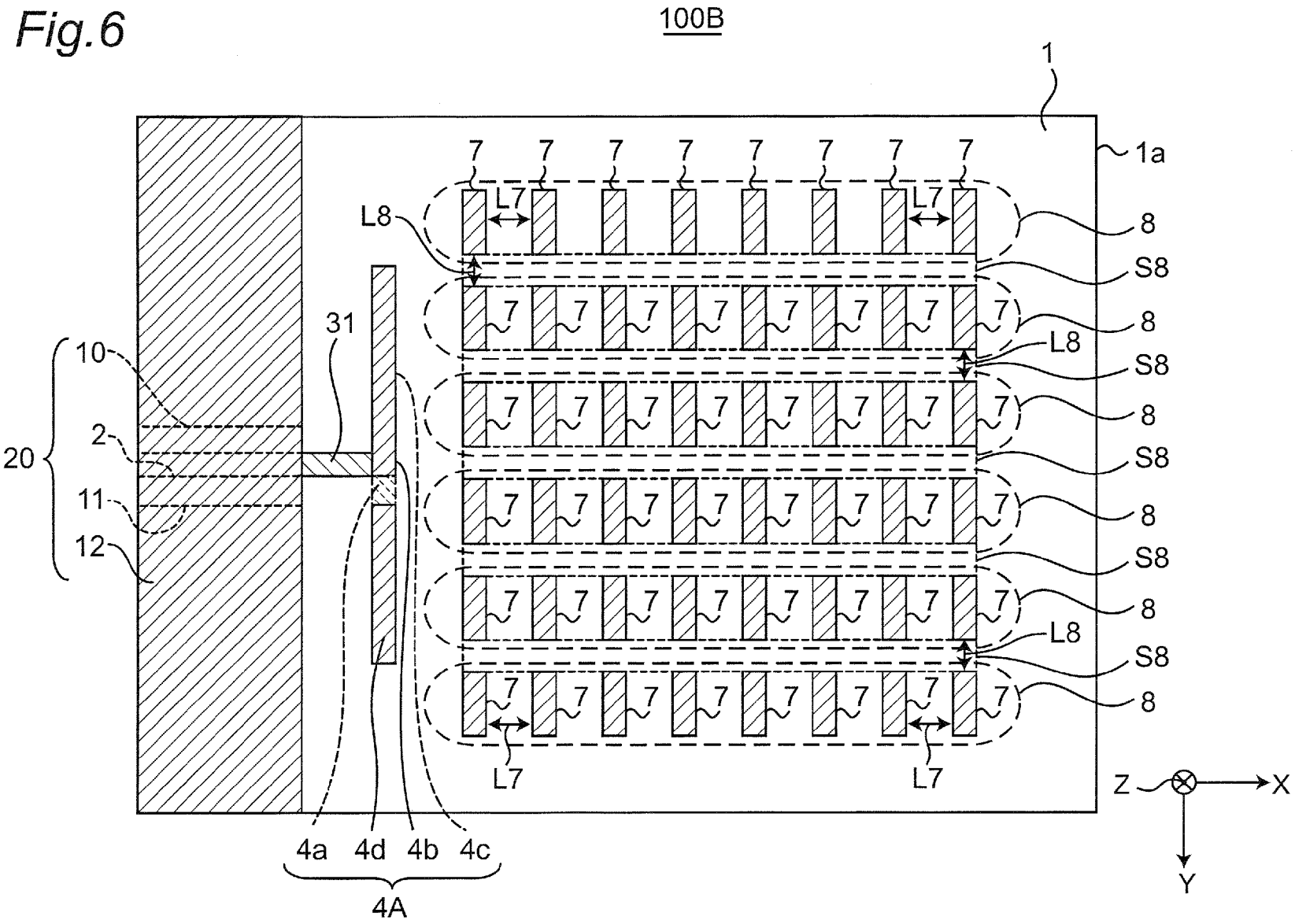
FIG. 6 is a reverse side view of the antenna apparatus 100B of FIG. 5.

FIG. 5 is a top view of an antenna apparatus 100B according to a second preferred embodiment of the present disclosure, and FIG. 6 is a reverse side view of the antenna apparatus 100B of FIG. 5. As compared with the antenna apparatus 100 according to the first preferred embodiment, the antenna apparatus 100B according to the present preferred embodiment is characterized by including a dipole antenna 4A instead of the dipole antenna 4, and further including six parasitic element arrays 8 each including eight parasitic elements 7. In the present preferred embodiment, only differences from the first preferred embodiment will be described.

Referring to FIGS. 5 and 6, the dipole antenna 4A is configured to include the feed elements 4*a* and 4*b*, and parasitic elements 4*c* and 4*d*. In this case, the parasitic element 4*c* is formed on the top surface of the dielectric substrate 1 so as to oppose to the feed element 4*b*, and to have a predetermined interval with the feed element 4*a*. In addition, the parasitic element 4*d* is formed on the reverse surface of the dielectric substrate 1 so as to oppose to the feed element 4*a* and to have a predetermined interval with the feed element 4*b*.

In addition, referring to FIG. 6, each of the parasitic element arrays 8 is configured to include the eight parasitic elements 7 formed on the reverse surface of the dielectric substrate 1. In this case, the parasitic elements 7 have a strip shape extending substantially parallel to a longitudinal direction (Y-axis direction) of the dipole antenna 4A. Further, in each of the parasitic element arrays 8, the parasitic elements 7 are arranged at predetermined intervals L7 and in a straight line parallel to the X-axis, so as to be electromagnetically coupled to each other.

In addition, referring to FIG. 6, the six parasitic element arrays 8 are formed substantially parallel to one another so that a pair of parasitic element arrays 8 adjacent to each other in the Y-axis direction form a pseudo-slot opening S8 having a predetermined width L8. In the case of FIG. 6, five pseudo-slot openings S8 extending in the X-axis direction are formed by the six parasitic element arrays 8. It is noted that parasitic element 7 in one of a pair of parasitic element arrays 8 adjacent to each other in the Y-axis direction faces a corresponding parasitic element 7 in another parasitic element array 8 so that the parasitic elements 7 have an interval L8 therebetween at their respective adjacent ends.

It is noted that, in the present preferred embodiment, the interval L7 is set to be equal to the interval L5, the width L8 is set to be equal to the width L6, and the parasitic elements 7 are formed so as to oppose to parasitic elements 5, respectively.

In each of the parasitic element arrays 8, the parasitic elements 7 adjacent to each other in the X-axis direction are electromagnetically coupled to each other in the X-axis direction, and each of the parasitic element arrays 8 operates as an electric wall extending in the X-axis direction. Then, a pseudo-slot opening S8 is formed between a pair of the parasitic element arrays 8 adjacent to each other in the Y-axis direction. Therefore, an electric field parallel to the Y-axis direction is generated in each of the pseudo-slot openings S8, and a magnetic current parallel to the X-axis direction flows through each of the pseudo-slot openings S8 accordingly. Therefore, the radio waves radiated from the dipole antenna 4A are transmitted through the reverse surface of the dielectric substrate 1 along the pseudo-slot openings S8 between the parasitic element arrays 8 so as to be guided in the X-axis direction, and are radiated in the end-fire direction from the edge portion 1*a* on the right side of the dielectric substrate 1. Namely, the antenna apparatus 100B operates with the pseudo-slot openings S8 serving as magnetic current sources. In this case, the radio waves are aligned in phase at the edge portion 1*a* of the dielectric substrate 1, and an equiphase wave plane is generated at the end portion 1*a*. It is noted that each parasitic element 7 in one of a pair of parasitic element arrays 8 adjacent to each other in the Y-axis direction and a corresponding parasitic element 7 in another parasitic element array 8 are not electromagnetically coupled to each other in the Y-axis direction, and thus do not resonate.

As described above, referring to FIGS. 5 and 6, the radio waves radiated from the dipole antenna 4A propagate through the top surface of the dielectric substrate 1 along the pseudo-slot openings S6 as magnetic currents, propagate through the reverse surface of the dielectric substrate 1 along the pseudo-slot openings S8 as magnetic currents, and are radiated in the end-fire direction from the edge portion 1*a* of the dielectric substrate 1.

According to the dipole antenna 4A of the present preferred embodiment, since the parasitic element 4*c* is electromagnetically coupled to the feed element 4*b*, and the parasitic element 4*d* is electromagnetically coupled to the feed element 4*a*, the dipole antenna 4A can radiate radio waves more efficiently than the above-described dipole antenna 4. Further, since the antenna apparatus 100B further includes the parasitic element arrays 8, radiation efficiency and opening efficiency can be increased than those of the above-described preferred embodiment and modified preferred embodiment.

The interval L7 is set to be equal to the interval L5 and the width L8 is set to be equal to the width L6 in the present preferred embodiment, however, the present disclosure is not limited to this. In addition, the interval L7 does not need to be equal to the interval L5 but is preferably equal to or smaller than $\lambda/8$. In addition, the width L8 does not need to be equal to the width L6 but is set to $\lambda/10$, for example. Further, the arrangement of the parasitic element arrays 6 on the top surface of the dielectric substrate 1 and the arrangement of the parasitic element arrays 8 on the reverse surface do not need to be identical. In addition, the antenna apparatus 100B includes the parasitic element arrays 6 and 8 in the present preferred embodiment, however, the present disclosure is not limited to this. The antenna apparatus 100B may include only either the parasitic element arrays 6 or 8.

Third Preferred Embodiment

Figure 7:
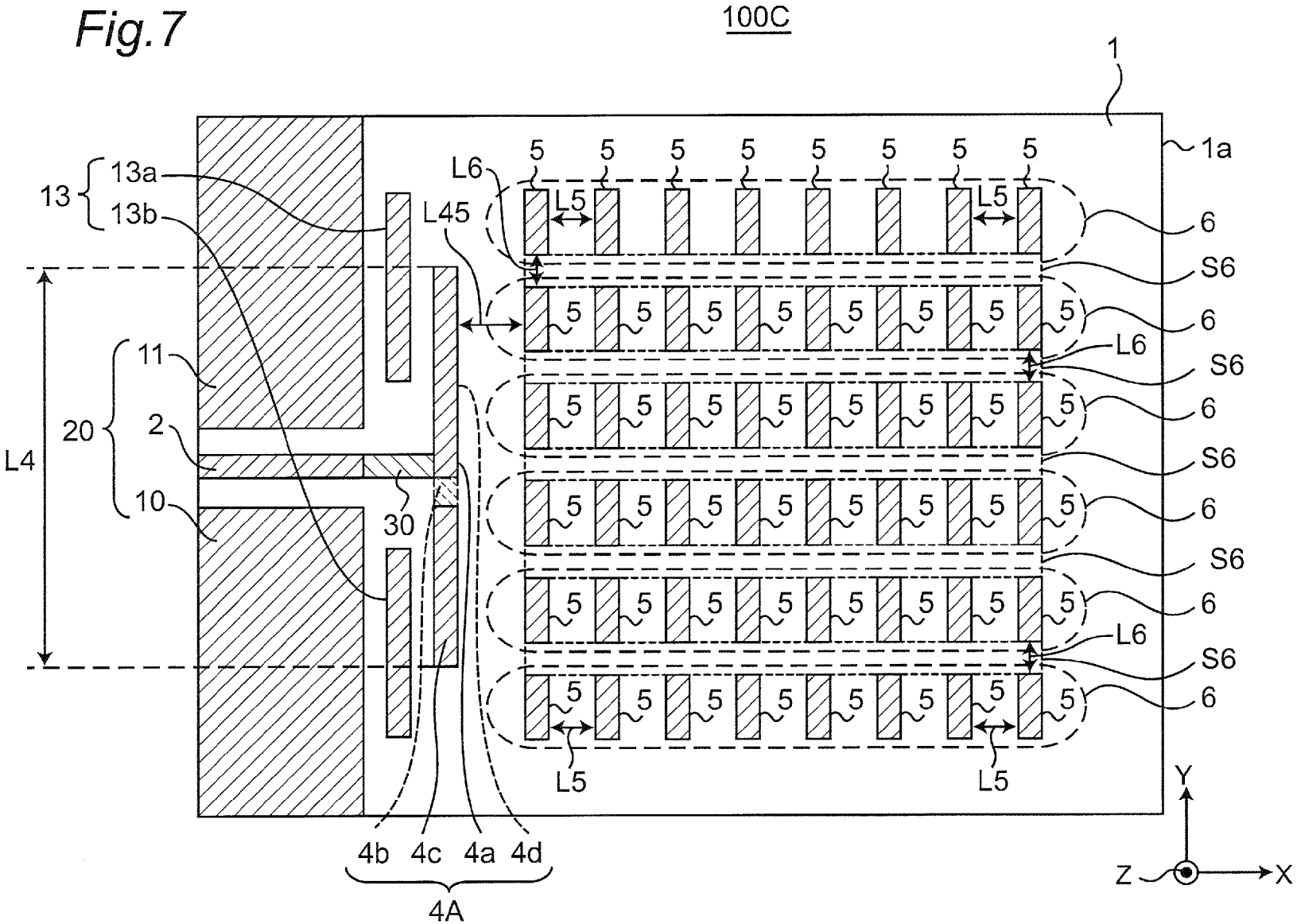
FIG. 7 is a top view of an antenna apparatus 100C according to a third preferred embodiment of the present disclosure.
Figure 8:
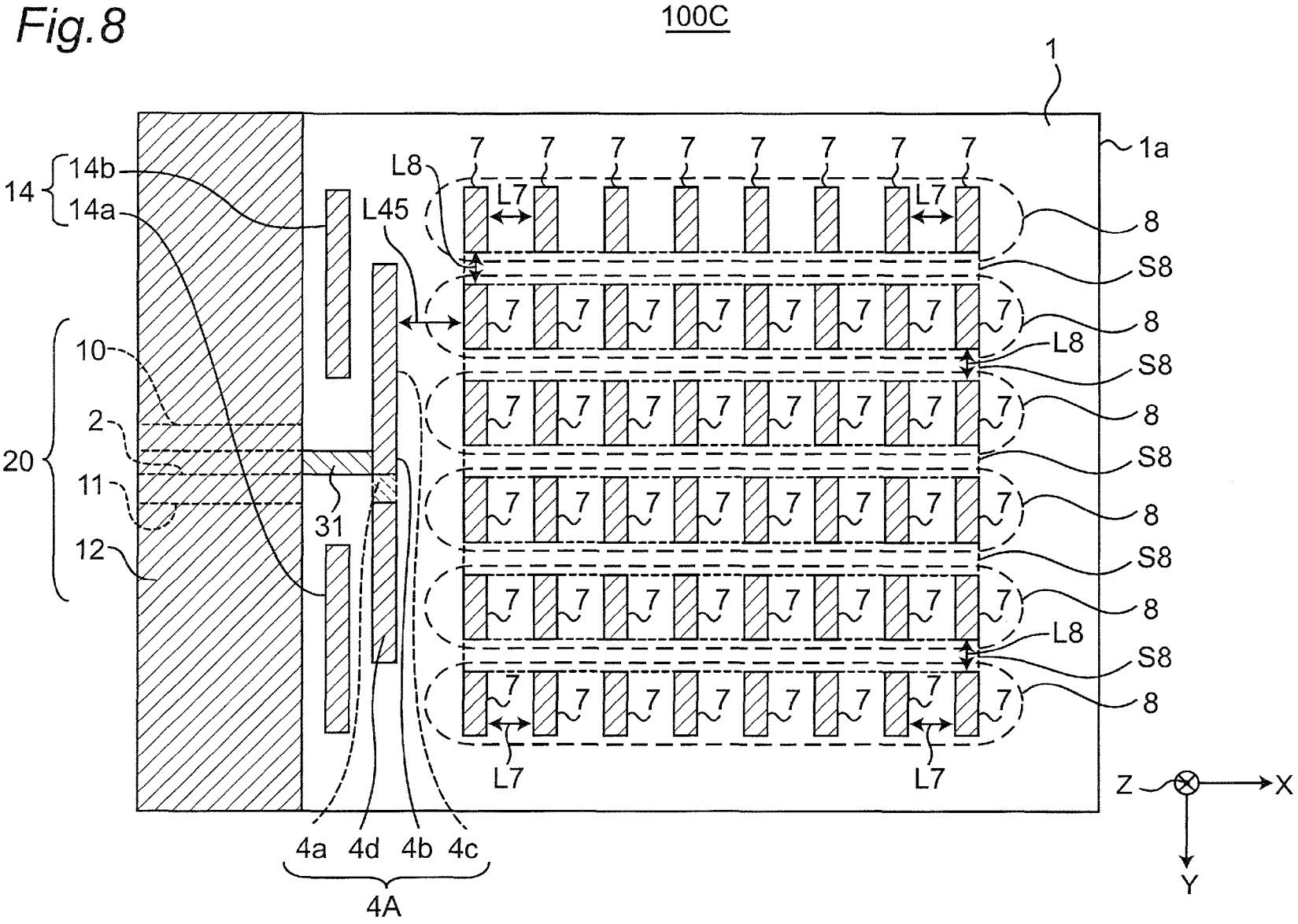
FIG. 8 is a reverse side view of the antenna apparatus 100C of FIG. 7.

FIG. 7 is a top view of an antenna apparatus 100C according to a third preferred embodiment of the present disclosure, and FIG. 8 is a reverse side view of the antenna apparatus 100C of FIG. 7. As compared with the antenna apparatus 100B according to the second preferred embodiment, the antenna apparatus 100C according to the present preferred embodiment is configured to further include a parasitic element pair 13 including parasitic elements 13*a* and 13*b*, and a parasitic element pair 14 including parasitic elements 14*a* and 14*b*. In the present preferred embodiment, only differences from the second preferred embodiment will be described.

Referring to FIGS. 7 and 8, the parasitic elements 13*a* and 13*b* have a strip shape and are formed on the top surface of the dielectric substrate 1. The parasitic elements 13*a* and 13*b* are formed in a straight line parallel to the longitudinal direction of the dipole antenna 4A, and are located on the opposite side of the dipole antenna 4A from parasitic element arrays 6, respectively. The parasitic elements 13*a* and 13*b* are formed so as to oppose to the dipole antenna 4A and to be electromagnetically coupled to the dipole antenna 4A, and operate as reflectors. In addition, the parasitic elements 14*a* and 14*b* have a strip shape and are formed on the reverse surface of the dielectric substrate 1. The parasitic elements 14*a* and 14*b* are formed in a straight line parallel to the longitudinal direction of the dipole antenna 4A, and are located on the opposite side of the dipole antenna 4A from parasitic element arrays 8, respectively. The parasitic elements 14*a* and 14*b* are formed so as to oppose to the dipole antenna 4A and to be electromagnetically coupled to the dipole antenna 4A, and operate as reflectors.

In addition, referring to FIG. 7, the parasitic element 13*a* is formed in a region of the top surface of the dielectric substrate 1 between the feed element 4*a* and the ground conductor 11, so as to extend in the Y-axis direction. In addition, the parasitic element 13*b* is formed in a region of the top surface of the dielectric substrate 1 between the parasitic element 4*c* and the ground conductor 10, so as to extend in the Y-axis direction. Further, the parasitic elements 14*a* and 14*b* are formed on the reverse surface of the dielectric substrate 1 so as to oppose to the parasitic elements 13*a* and 13*b*, respectively. The parasitic element 13*a* is electromagnetically coupled to the feed element 4*a*, the parasitic element 13*b* is electromagnetically coupled to the parasitic element 4*c*, the parasitic element 14*a* is electromagnetically coupled to a parasitic element 4*d*, and the parasitic element 14*b* is electromagnetically coupled to a feed element 4*b*.

According to the present preferred embodiment, since the parasitic element pairs 13 and 14 which operate as reflectors are provided at locations on the opposite side of the dipole antenna 4A from a radiation direction of radio waves from the dipole antenna 4A, the radio waves radiated from the dipole antenna 4A can be directed in the end-fire direction more efficiently than the second preferred embodiment. Therefore, it is possible to improve the FB (Front to Back) ratio than that of the second preferred embodiment. In particular, the advantageous effects provided by the parasitic element pairs 13 and 14 become large, when the size in the Y-axis direction of the antenna apparatus 100C increases due to an increase in the numbers of the parasitic element arrays 6 and 8. In addition, the advantageous effects provided by the parasitic element pairs 13 and 14 become large, when the feeder line 20 is a feeder line such as a microstrip line, which does not include the ground conductors 10 and 11 operating as reflectors.

It is noted that the antenna apparatus 100C includes two parasitic element pairs 13 and 14 in the present preferred embodiment, however, the present disclosure is not limited to this. The antenna apparatus 100C may include only one of the parasitic element pairs 13 or 14.

In addition, the antenna apparatus 100C includes the parasitic element arrays 6 and 8 in the present preferred embodiment, however, the present disclosure is not limited to this. The antenna apparatus 100C may include only either the parasitic element arrays 6 or 8.

Fourth Preferred Embodiment

Figure 9:
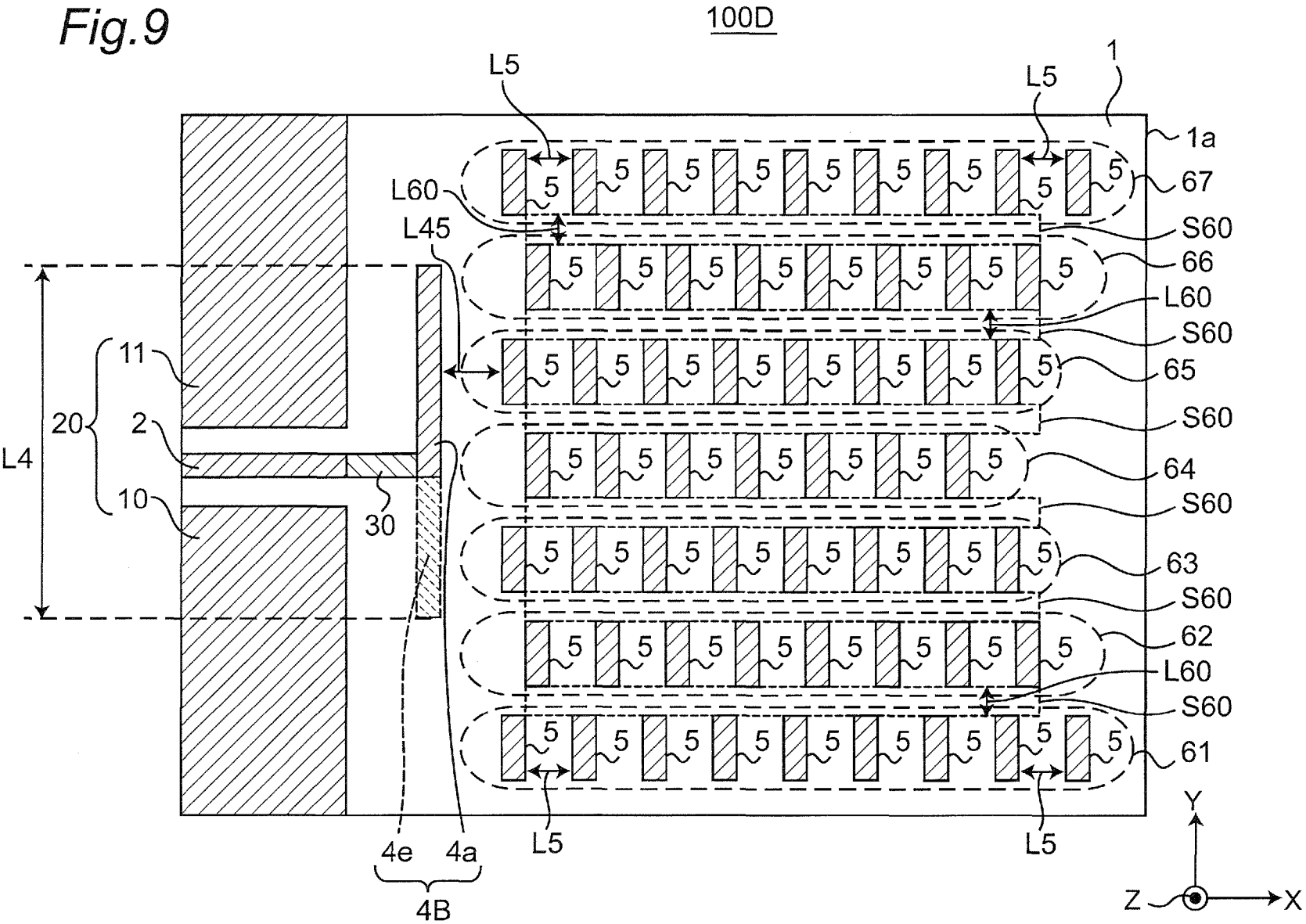
FIG. 9 is a top view of an antenna apparatus 100D according to a fourth preferred embodiment of the present disclosure.
Figure 10:
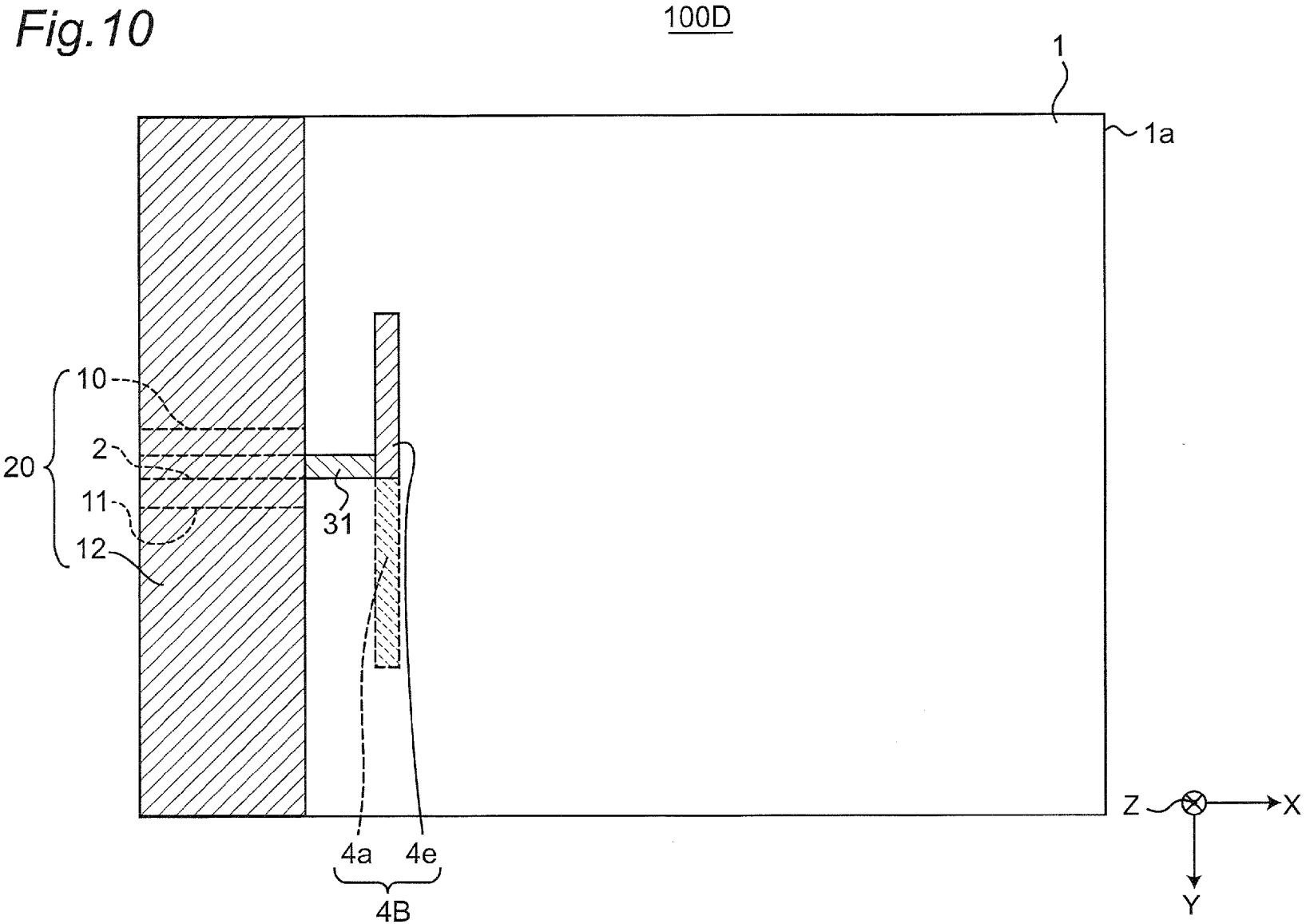
FIG. 10 is a reverse side view of the antenna apparatus 100D of FIG. 9.

FIG. 9 is a top view of an antenna apparatus 100D according to a fourth preferred embodiment of the present disclosure and FIG. 10 is a reverse side view of the antenna apparatus 100D of FIG. 9. As compared with the antenna apparatus 100A according to the modified preferred embodiment of the first preferred embodiment, the antenna apparatus 100D according to the present preferred embodiment is characterized by including a feed element 4*e* instead of the feed element 4*b*. In the present preferred embodiment, only differences from the modified preferred embodiment of the first preferred embodiment will be described. In the above-described preferred embodiments and modified preferred embodiment, the each electrical lengths of feed elements 4*a* and 4*b* are set to equal values. On the other hand, the electrical length of the feed element 4*e* is set to be shorter than the electrical length of the feed element 4*b* in the present preferred embodiment. In addition, the feed elements 4*a* and 4*e* operate as a dipole antenna 4B having an electrical length L4 from the open end of the feed element 4*a* to an open end of the feed element 4*e*.

In the present preferred embodiment and the above-described preferred embodiments, since the feeder line 20 is an unbalanced transmission line, if the balanced dipole antenna 4 is connected to the feeder line 20, then a current flowing through the feed element 4*a* and a current flowing through the feed element 4*b* become unbalanced. As a result, a beam in a horizontal plane may not be directed in an end-fire direction. Since each of the antenna apparatuses 100, 100A, 100B, and 100C according to the above-described preferred embodiments and modified preferred embodiment has a beam width smaller than that of the prior art, unless the direction of the beam is directed to the front (which is the end-fire direction) of the antenna apparatuses 100, 100A, 100B, and 100C, user usability becomes poor.

According to the antenna apparatus 100D of the present preferred embodiment, by setting the electrical length of the feed element 4*e* to be shorter than the electrical length of the feed element 4*a*, the above-described unbalanced currents are adjusted, enabling to direct the beam in the end-fire direction. In addition, since the radiation direction of the radio waves from the dipole antenna 4B is directed in the end-fire direction, the wave guide efficiency of parasitic element arrays 61 to 67 is improved than those of the above-described preferred embodiments and modified preferred embodiment.

The electrical length of the feed element 4*e* is set to be shorter than the electrical length of the feed element 4*a*, however, the present disclosure is not limited to this. The electrical length of the feed element 4*a* and the electrical length of the feed element 4*e* are set to be different from each other so that the radiation direction of the radio waves from the dipole antenna 4B is directed in a desired direction such as the end-fire direction.

In addition, parasitic element arrays are not provided on the reverse surface of the dielectric substrate 1 in the present preferred embodiment, however, the present disclosure is not limited to this. For example, at least three parasitic element arrays similar to the parasitic element arrays 61 to 67 may be provided on the reverse surface of the dielectric substrate 1. In this case, in each parasitic element array, a plurality of parasitic elements (e.g., the parasitic elements 7 of FIG. 8) have a strip shape substantially parallel to a longitudinal direction of the dipole antenna 4B, and are arranged at predetermined intervals so as to be electromagnetically coupled to each other. In addition, the at least three parasitic element arrays are arranged substantially parallel to one another at predetermined intervals so that a pseudo-slot opening (e.g., the pseudo-slot opening S8 of FIG. 8) that allows the radio wave from the dipole antenna 4B to propagate therethrough as a magnetic current is formed between each pair of adjacent parasitic element arrays.

Fifth Preferred Embodiment

Figure 11:
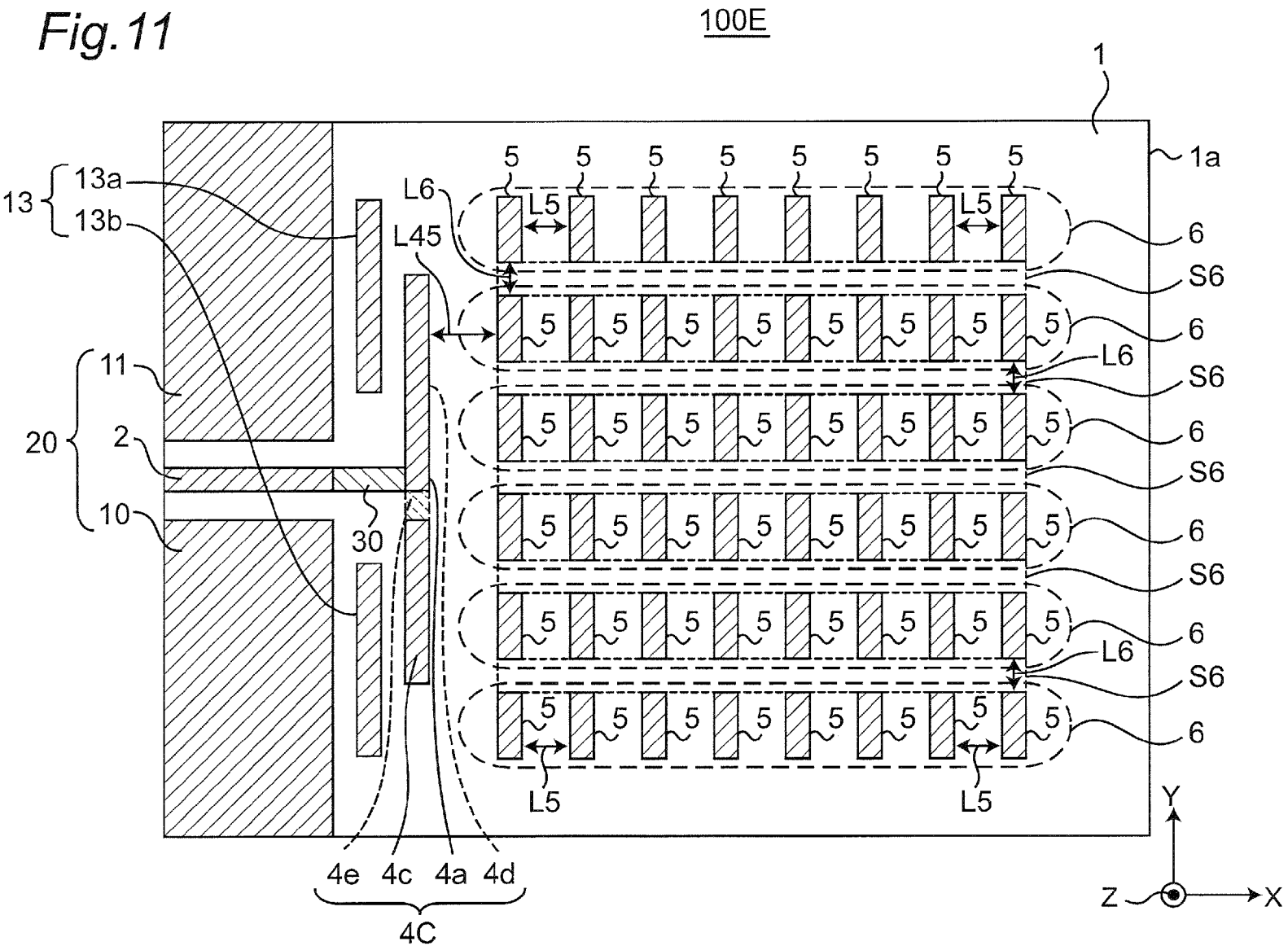
FIG. 11 is a top view of an antenna apparatus 100E according to a fifth preferred embodiment of the present disclosure.
Figure 12:
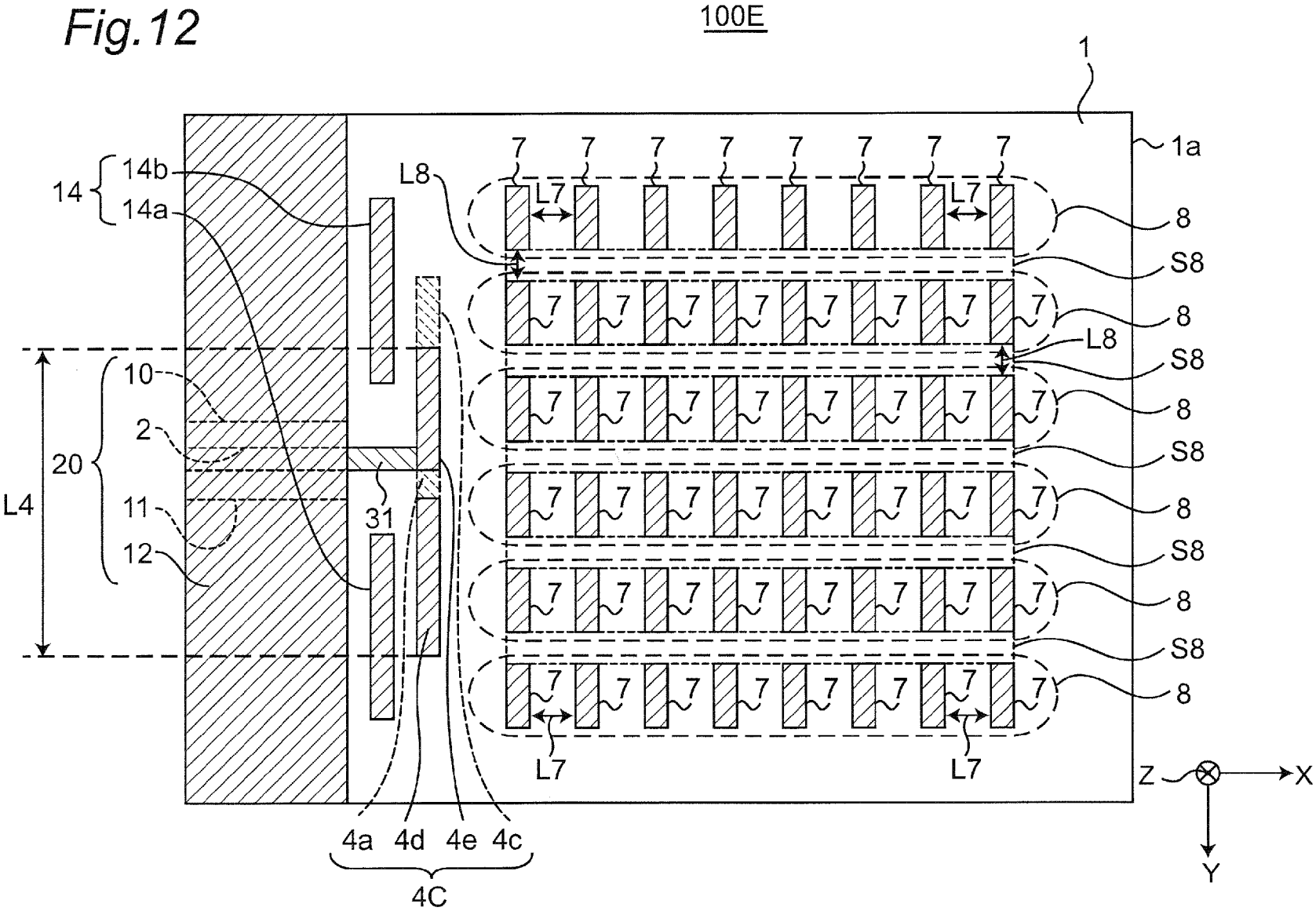
FIG. 12 is a reverse side view of the antenna apparatus 100E of FIG. 11.

FIG. 11 is a top view of an antenna apparatus 100E according to a fifth preferred embodiment of the present disclosure and FIG. 12 is a reverse side view of the antenna apparatus 100E of FIG. 11. As compared with the antenna apparatus 100C according to the third preferred embodiment, the antenna apparatus 100E according to the present preferred embodiment is characterized by including the feed element 4*e* instead of the feed element 4*b*. In the present preferred embodiment, only differences from the third preferred embodiment will be described.

In the present preferred embodiment, the electrical length of the feed element 4*e* is set to be shorter than the electrical length of the feed element 4*b*, in a manner the same as that of the antenna apparatus 100D according to the fourth preferred embodiment. In addition, the feed elements 4*a*, 4*c*, 4*d*, and 4*e* operate as a dipole antenna 4C having an electrical length L4 from the open end of the feed element 4*a* to the open end of the feed element 4*e*.

According to the present preferred embodiment, by setting the electrical length of the feed element 4*e* to be shorter than the electrical length of the feed element 4*a* in a manner similar to that of the fourth preferred embodiment, the beam can be directed in the end-fire direction. In addition, since a radiation direction of radio waves from the dipole antenna 4C is directed in the end-fire direction, the wave guide efficiency of parasitic element arrays 6 and 8 is improved than that of the third preferred embodiment.

The electrical length of the feed element 4*e* is set to be shorter than the electrical length of the feed element 4*a*, however, the present disclosure is not limited to this. The electrical length of the feed element 4*a* and the electrical length of the feed element 4*e* are set to be different from each other so that the radiation direction of radio waves from the dipole antenna 4C is directed in a desired direction such as the end-fire direction.

In addition, the electrical length of the parasitic element 4*c* is set to be longer than the electrical length of the feed element 4*e* in the present preferred embodiment, however, the present disclosure is not limited to this. The electrical length of the parasitic element 4*c* may be set to be substantially equal to the electrical length of the feed element 4*e*.

Further, the antenna apparatus 100E includes the parasitic element arrays 6 and 8 in the present preferred embodiment, however, the present disclosure is not limited to this. The antenna apparatus 100E may include only either the parasitic element arrays 6 or 8. Still further, the antenna apparatus 100E includes parasitic element pairs 13 and 14, however, the present disclosure is not limited to this. The antenna apparatus 100E may include only one of the parasitic element pairs 13 or 14.

Sixth Preferred Embodiment

Figure 13:
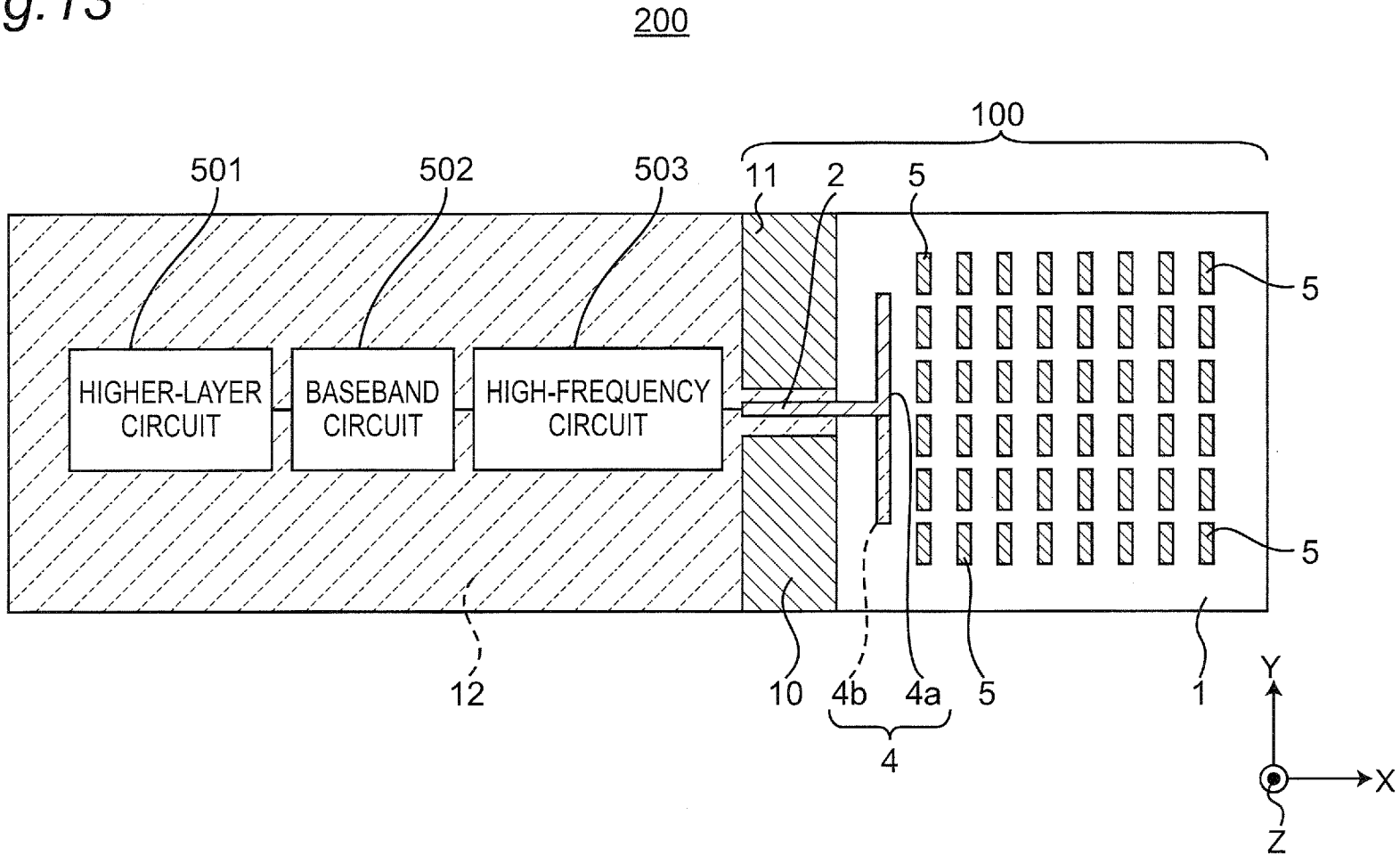
FIG. 13 is a top view of a wireless communication apparatus 200 according to a sixth preferred embodiment of the present disclosure.

FIG. 13 is a top view of a wireless communication apparatus 200 according to a sixth preferred embodiment of the present disclosure. Referring to FIG. 13, the wireless communication apparatus 200 is a wireless communication apparatus such as a wireless module substrate, and is configured to include the antenna apparatus 100 according to the first preferred embodiment, a higher-layer circuit 501, a baseband circuit 502, and a high-frequency circuit 503. In this case, the higher-layer circuit 501, the baseband circuit 502, and the high-frequency circuit 503 are provided on the top surface of the dielectric substrate 1. It is noted that the respective circuits 501 to 503 are provided in the -X-axis direction with respect to the dipole antenna 4.

Referring to FIG. 13, the higher layer circuit 501 is a circuit of a layer higher than the MAC (Media Access Control) layer and the physical layers of an application layer and the like, and includes a communication circuit and a host processing circuit, for example. The higher layer circuit 501 outputs a predetermined data signal to the baseband circuit 502, and executes predetermined signal processing for a baseband signal from the baseband circuit 502 so as to convert the baseband signal into a data signal. In addition, the baseband circuit 502 executes a waveform shaping process for the data signal from the higher layer circuit 501, and thereafter, modulates a predetermined carrier signal according to the processed data signal and outputs the resultant signal to the high-frequency circuit 503. Further, the baseband circuit 502 demodulates the high-frequency signal from the high-frequency circuit 503 into the baseband signal, and outputs the baseband signal to the higher layer circuit 501.

In addition, referring to FIG. 13, the high-frequency circuit 503 executes a power amplification process and a waveform shaping process for the high-frequency signal from the baseband circuit 502 in the radio-frequency band, and outputs the resultant signal to the dipole antenna 4 via the feeder line 2. Further, the high-frequency circuit 503 executes predetermined processing of frequency conversion and the like for the high-frequency signal wirelessly received by the dipole antenna 4B, and thereafter, outputs the resultant signal to the baseband circuit 502.

The high-frequency circuit 503 and the antenna apparatus 100 are connected to each other via a high-frequency transmission line. In addition, an impedance matching circuit is provided between the high-frequency circuit 503 and the antenna apparatus 100 when needed. The wireless communication apparatus 200 configured as described above wirelessly transmits and receives the high-frequency signal by using the antenna apparatus 100, and therefore, it is possible to realize a wireless communication apparatus having a size smaller than that of the prior art and a gain higher than that of the prior art.

The wireless communication apparatus 200 according to the present preferred embodiment includes the antenna apparatus 100, however, the present disclosure is not limited to this. The wireless communication apparatus 200 may include the antenna apparatus 100A, 100B, 100C, 100D or 100E.

In addition, the wireless communication apparatus 200 according to the present preferred embodiment performs wireless transmission and reception, however, the present disclosure is not limited to this. The wireless communication apparatus 200 may perform only wireless transmission or only wireless reception.

IMPLEMENTATION EXAMPLES

With reference to FIGS. 14 to 22, results obtained by performing three-dimensional electromagnetic field analysis on the antenna apparatus 100 of FIG. 1 will be described. It is noted that the number of parasitic element arrays 6 is set to 5, and the number of parasitic elements 5 included in each parasitic element array 6 is set to 20 in FIGS. 14 to 22. Further, the thickness of the dielectric substrate 1 is set to 0.2 mm and the frequency of a high-frequency signal to be fed to the dipole antenna 4 is set to 60 GHz.

Figure 14:
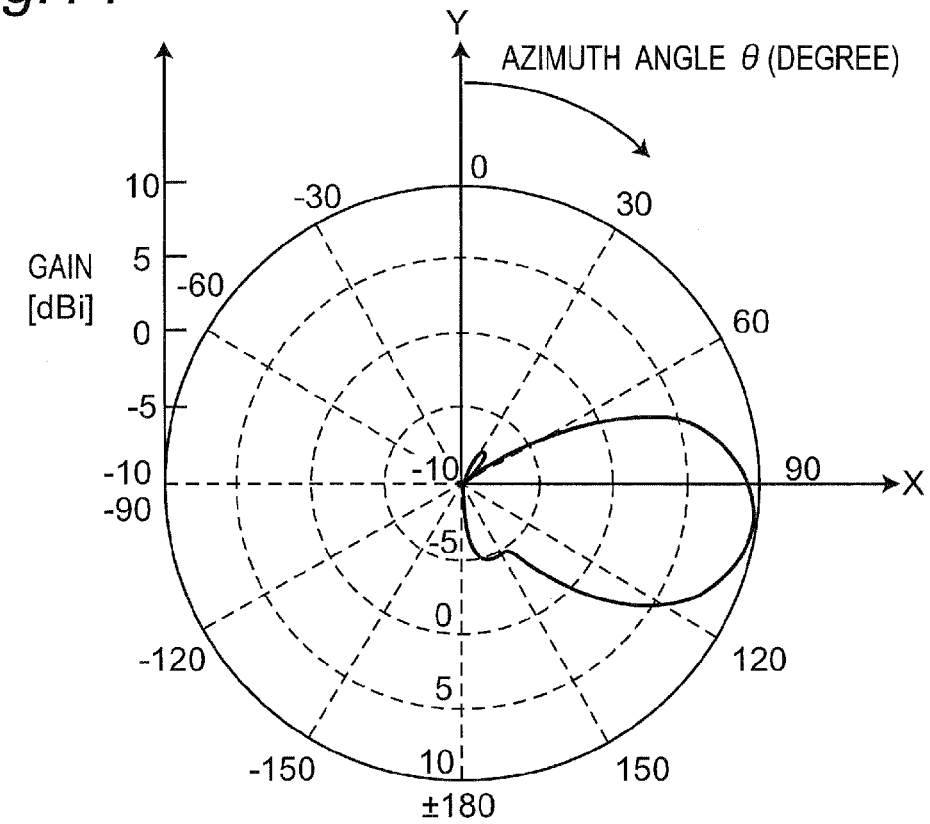
FIG. 14 is a graph showing a radiation pattern on an XY-plane, when the number of parasitic element arrays 6 is set to 5 and the number of parasitic elements 5 included in each of the parasitic element arrays 6 is set to 20 in the antenna apparatus 100 of FIG. 1.
Figure 15:
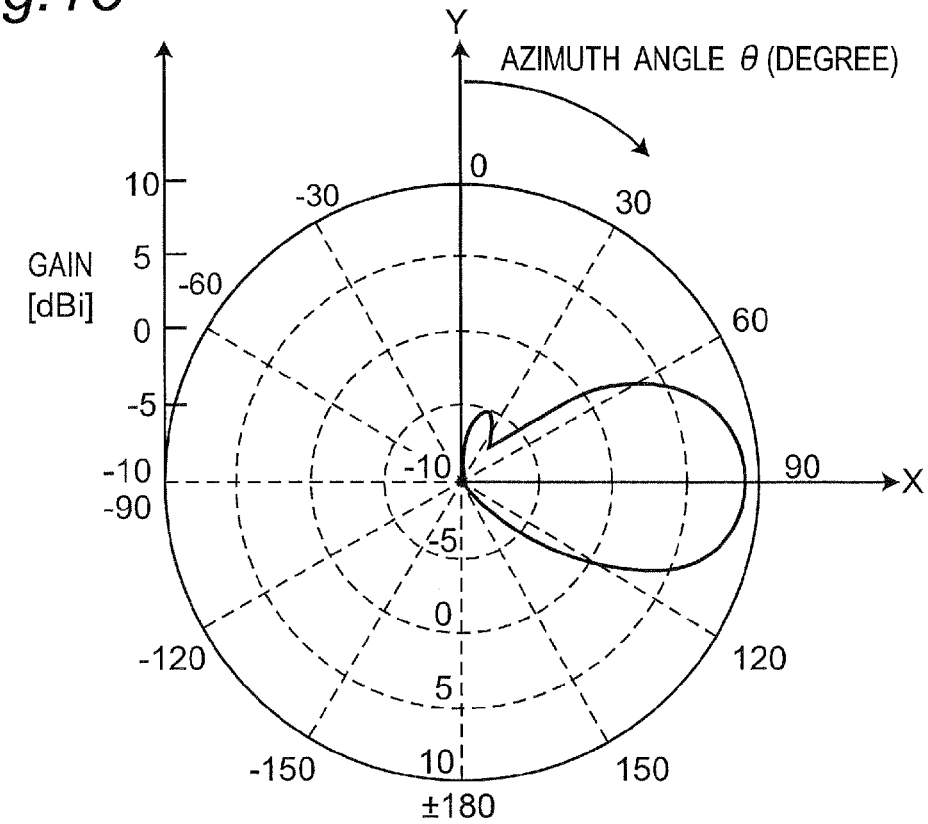
FIG. 15 is a graph showing a radiation pattern on the XY-plane, when the number of the parasitic element arrays 6 is set to 5, the number of the parasitic elements 5 included in each of the parasitic element arrays 6 is set to 20, and the length of a feed element 4*b* is set to be shorter than the length of a feed element 4*a* in the antenna apparatus 100 of FIG. 1.
Figure 16:
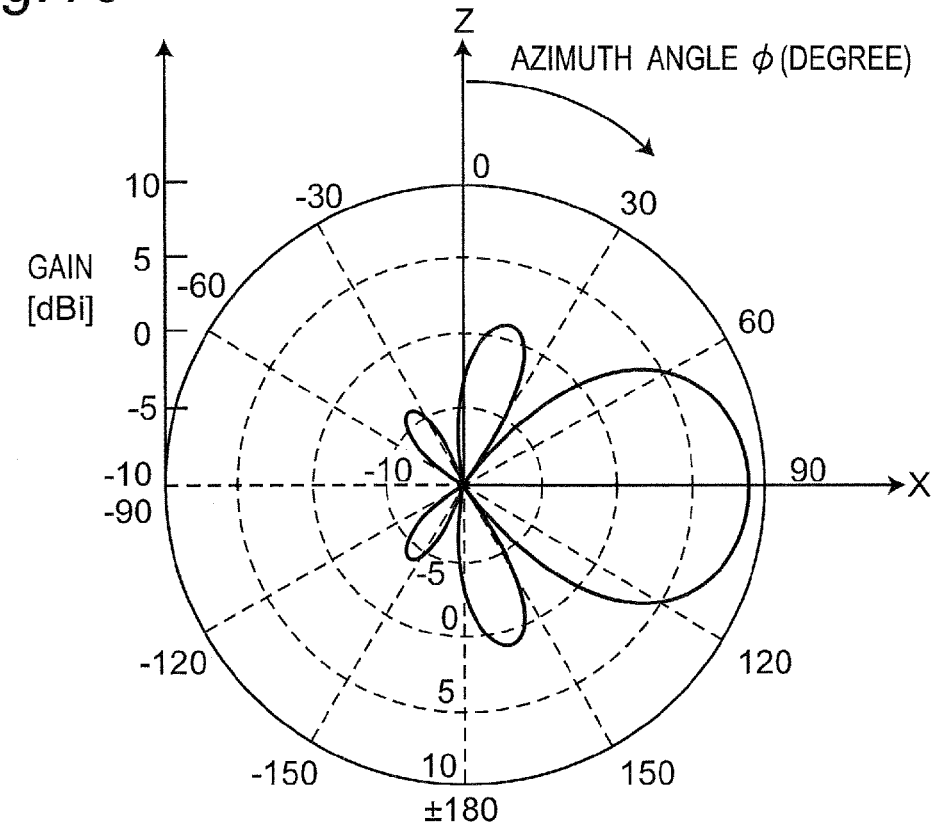
FIG. 16 is a graph showing a radiation pattern on an XZ-plane, when the number of the parasitic element arrays 6 is set to 5, the number of the parasitic elements 5 included in each of the parasitic element arrays 6 is set to 20, and the length of the feed element 4*b* is set to be shorter than the length of the feed element 4*a* in the antenna apparatus 100 of FIG. 1.

FIG. 14 is a graph showing a radiation pattern on the XY-plane of the antenna apparatus 100 of FIG. 1. As shown in FIG. 14, it can be seen that a relatively narrow beam width can be obtained in the XY-plane. In addition, FIGS. 15 and 16 are graphs showing radiation patterns on the XY-plane and the XZ-plane, respectively, when the length of the feed element 4*b* is set to be shorter than the length of the feed element 4*a* in the antenna apparatus 100 of FIG. 1. As shown in FIGS. 15 and 16, it can be seen that by setting the length of the feed element 4*b* to be shorter than the length of the feed element 4*a*, the beam direction is directed in the X-axis direction (end-fire direction) without any change in beam width.

Figure 17:
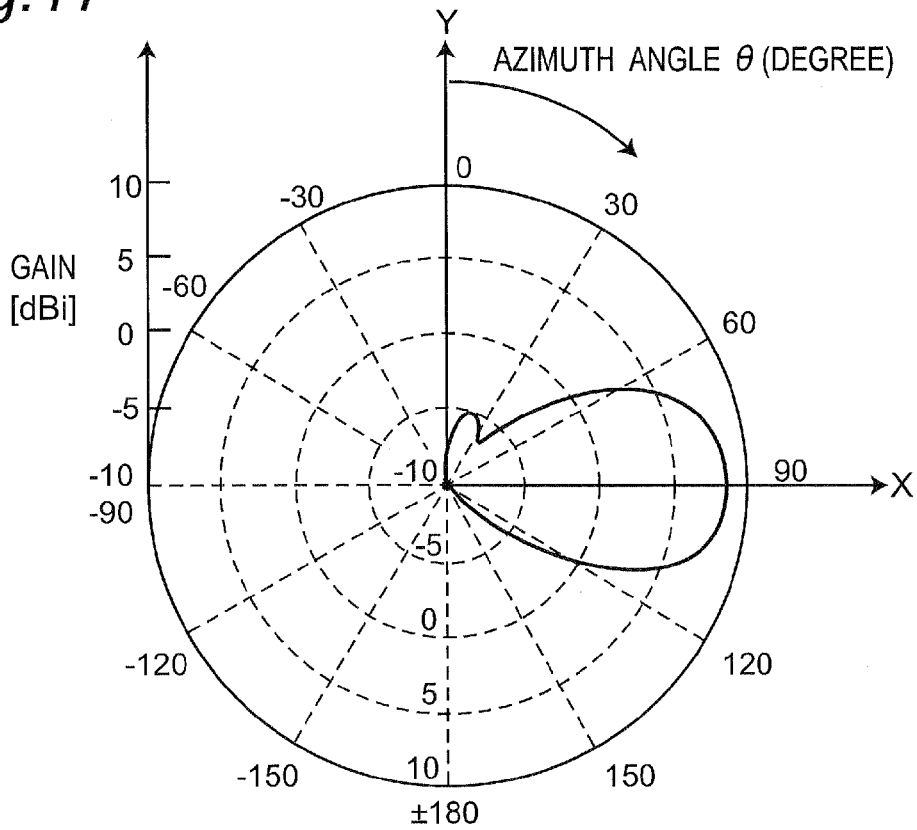
FIG. 17 is a graph showing a radiation pattern on the XY-plane, when the number of the parasitic element arrays 6 is set to 5, the number of the parasitic elements 5 included in each of the parasitic element arrays 6 is set to 20, the length of the feed element 4*b* is set to be shorter than the length of the feed element 4*a*, and the parasitic element arrays 6 of the even-numbered rows are shifted by L5/2 in an X-axis direction in the antenna apparatus 100 of FIG. 1.
Figure 18:
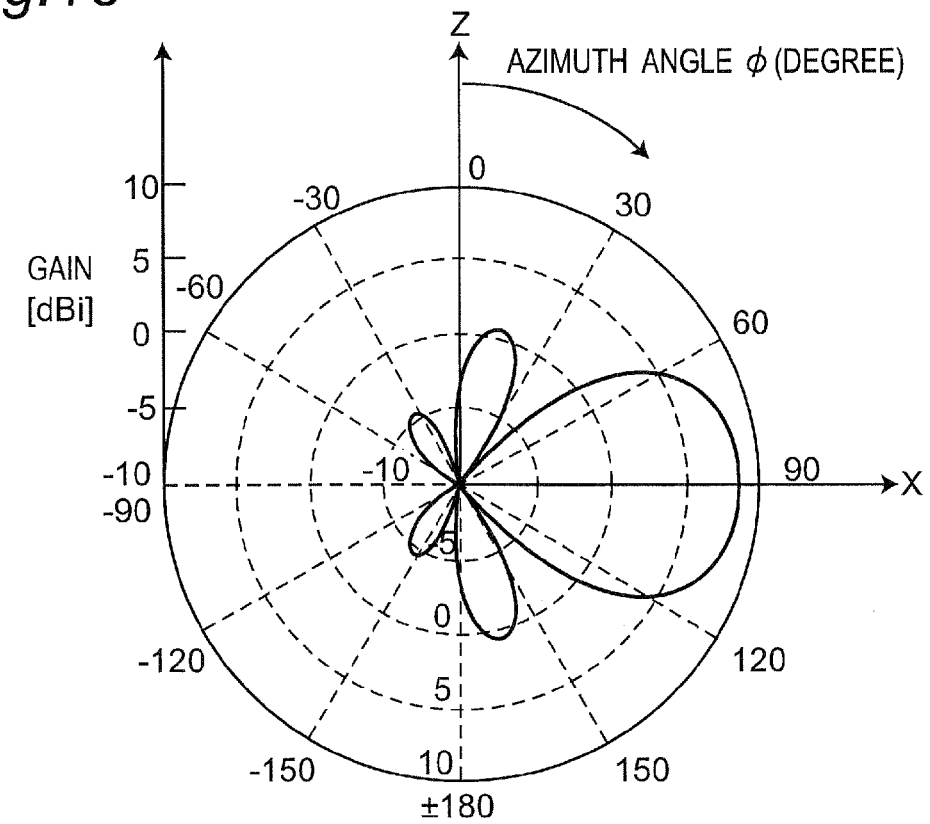
FIG. 18 is a graph showing a radiation pattern on the XZ-plane, when the number of the parasitic element arrays 6 is set to 5, the number of the parasitic elements 5 included in each of the parasitic element arrays 6 is set to 20, the length of the feed element 4*b* is set to be shorter than the length of the feed element 4*a*, and the parasitic element arrays 6 of the even-numbered rows are shifted by L5/2 in the X-axis direction in the antenna apparatus 100 of FIG. 1.

FIGS. 17 and 18 are graphs showing radiation patterns on the XY-plane and the XZ-plane, respectively, when the length of the feed element 4*b* is set to be shorter than the length of the feed element 4*a*, and the parasitic element arrays 6 of the even-numbered rows are shifted by L5/2 in the X-axis direction in the antenna apparatus 100 of FIG. 1. Comparing FIGS. 17 and 18 with FIGS. 15 and 16, it can be seen that even if the arrangement of the parasitic element arrays 6 is changed, the radiation characteristics do not substantially change.

Figure 19:
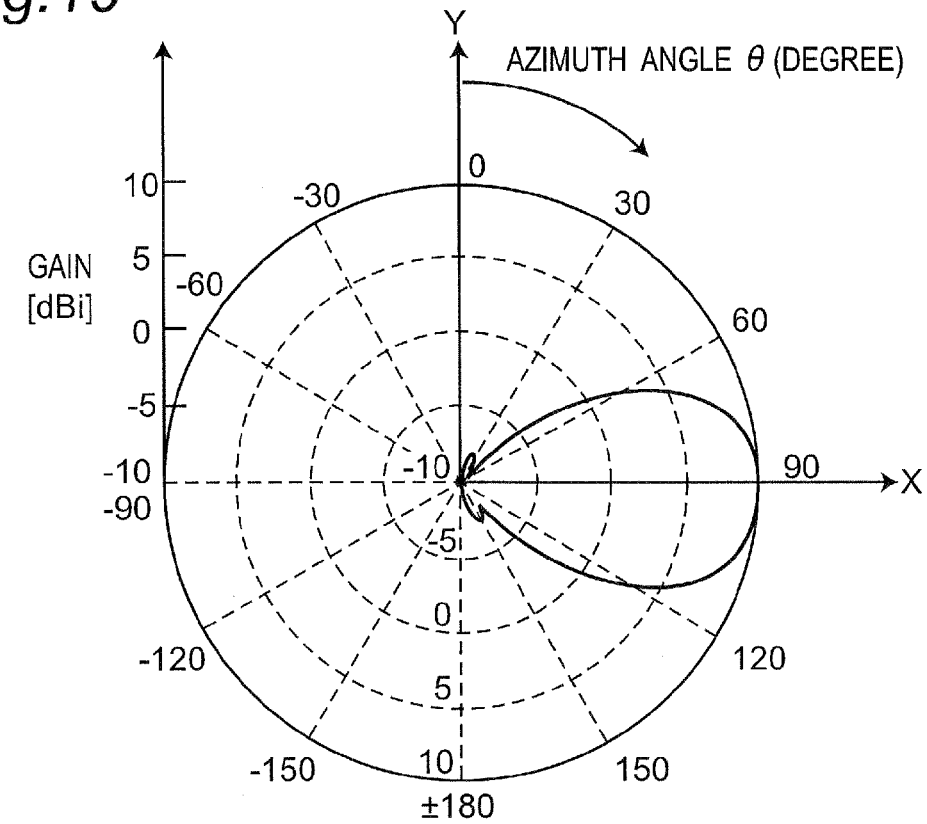
FIG. 19 is a graph showing a radiation pattern on the XY-plane, when the number of the parasitic element arrays 6 is set to 5, the number of the parasitic elements 5 included in each of the parasitic element arrays 6 is set to 20, the length of the feed element 4*b* is set to be shorter than the length of the feed element 4*a*, and parasitic elements 4*c* and 4*d* are added in the antenna apparatus 100 of FIG. 1.
Figure 20:
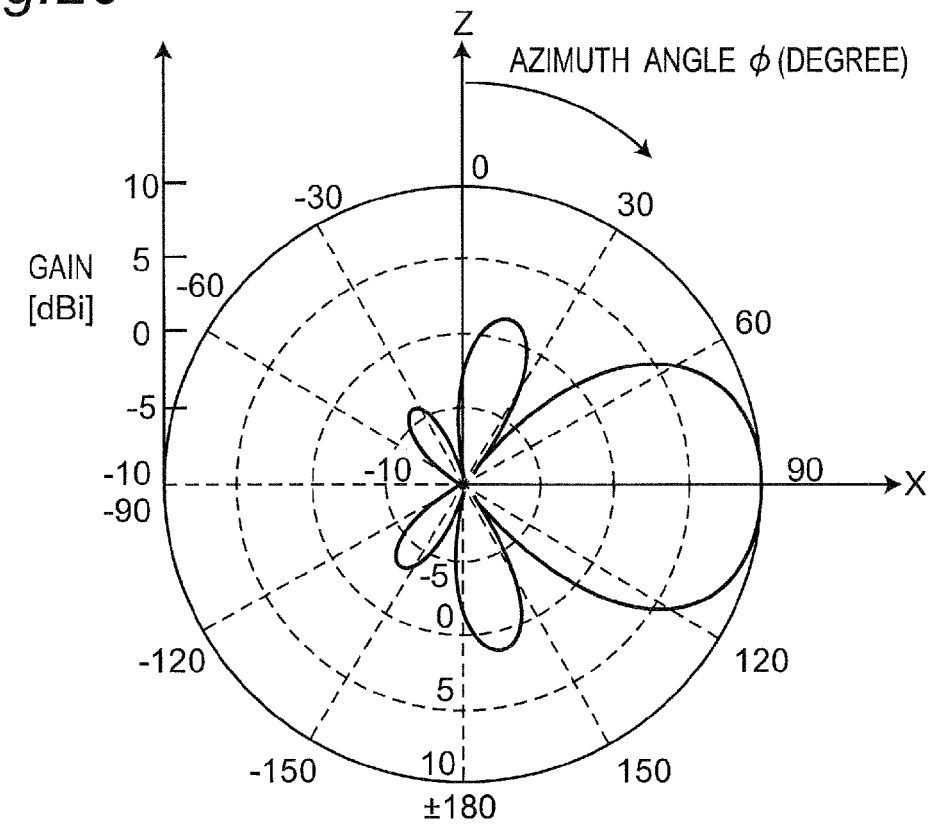
FIG. 20 is a graph showing a radiation pattern on the XZ-plane, when the number of the parasitic element arrays 6 is set to 5, the number of the parasitic elements 5 included in each of the parasitic element arrays 6 is set to 20, the length of the feed element 4*b* is set to be shorter than the length of the feed element 4*a*, and the parasitic elements 4*c* and 4*d* are added in the antenna apparatus 100 of FIG. 1.

FIGS. 19 and 20 are graphs showing radiation patterns on the XY-plane and the XZ-plane, respectively, when the length of the feed element 4*b* is set to be shorter than the length of the feed element 4*a*, and parasitic elements 4*c* and 4*d* (See FIGS. 5 and 6, for example) are added in the antenna apparatus 100 of FIG. 1. Comparing FIGS. 19 and 20 with FIGS. 15 and 16, it can be seen that by adding the parasitic elements 4*c* and 4*d*, the gain increases substantially without any change in the shapes of the radiation patterns.

Figure 21:
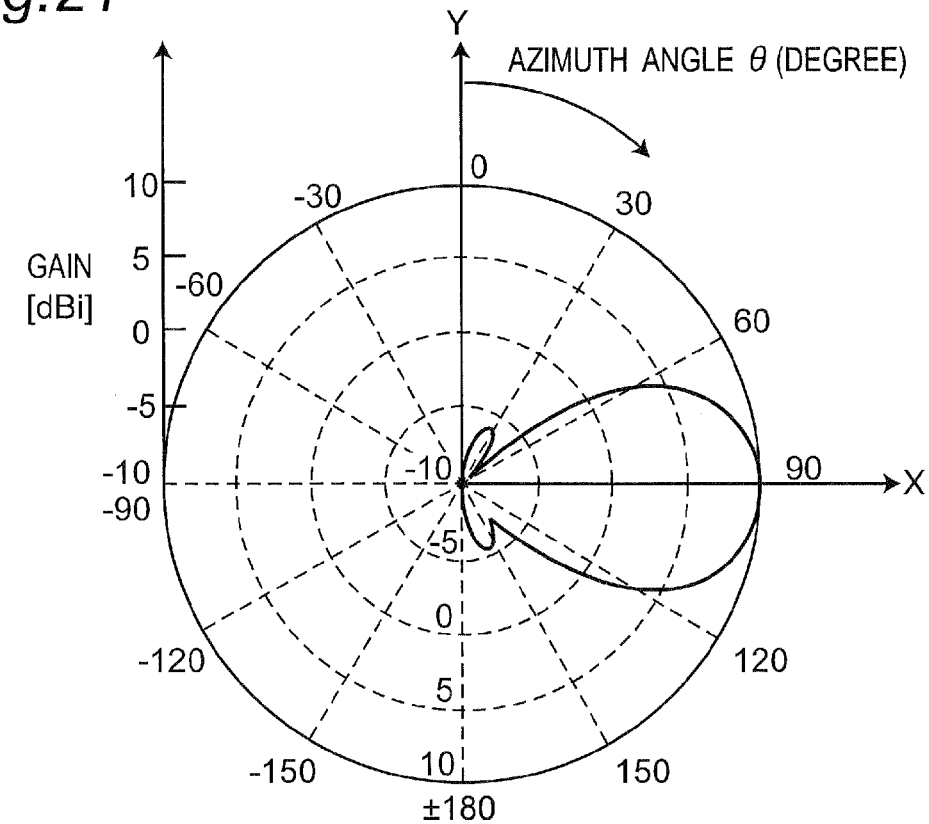
FIG. 21 is a graph showing a radiation pattern on the XY-plane, when the number of the parasitic element arrays 6 is set to 5, the number of the parasitic elements 5 included in each of the parasitic element arrays 6 is set to 20, the length of the feed element 4*b* is set to be shorter than the length of the feed element 4*a*, the parasitic elements 4*c* and 4*d* are added, and parasitic element pairs 13 and 14 are added in the antenna apparatus 100 of FIG. 1.
Figure 22:
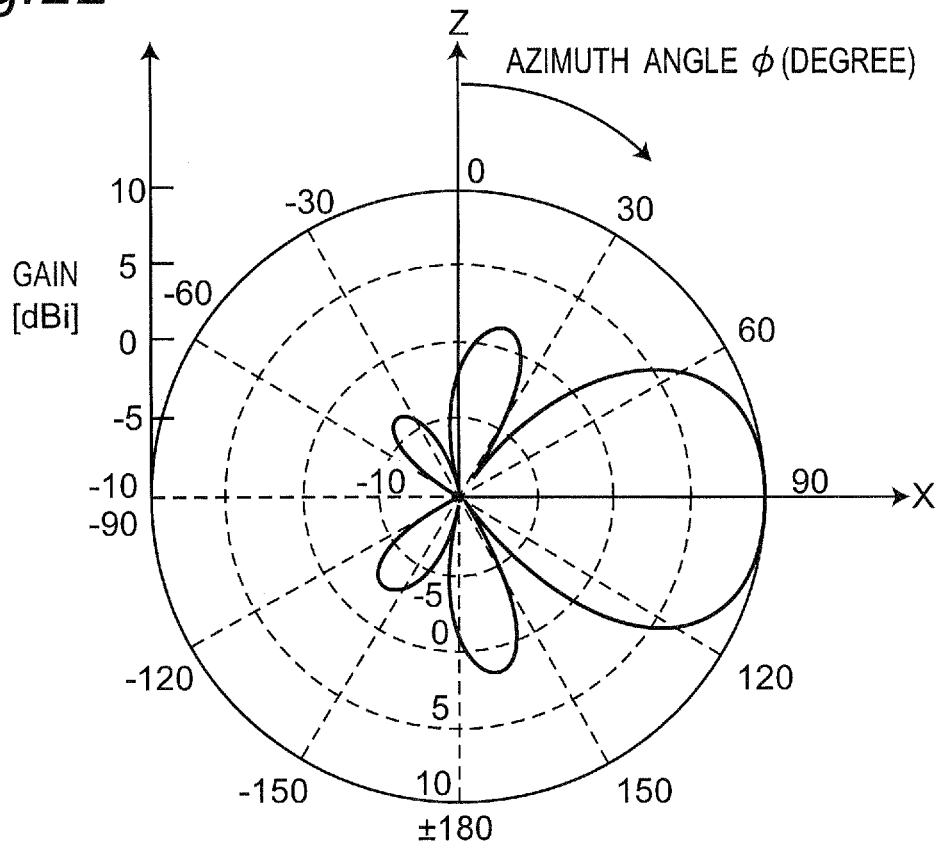
FIG. 22 is a graph showing a radiation pattern on the XZ-plane, when the number of the parasitic element arrays 6 is set to 5, the number of the parasitic elements 5 included in each of the parasitic element arrays 6 is set to 20, the length of the feed element 4*b* is set to be shorter than the length of the feed element 4*a*, the parasitic elements 4*c* and 4*d* are added, and the parasitic element pairs 13 and 14 are added in the antenna apparatus 100 of FIG. 1.

FIGS. 21 and 22 are graphs showing radiation patterns on the XY-plane and the XZ-plane, respectively, when the length of the feed element 4*b* is set to be shorter than the length of the feed element 4*a*, parasitic elements 4*c* and 4*d* are added, and parasitic element pairs 13 and 14 (See FIGS. 7 and 8, for example) are added in the antenna apparatus 100 of FIG. 1. Comparing FIGS. 21 and 22 with FIGS. 15 to 18, it can be seen that by adding the parasitic element pairs 13 and 14, the gain increases substantially without any change in the shapes of the radiation patterns.

Next, with reference to FIGS. 23 and 24, there will be described results of study of optimal values for the interval L5 between the feed elements 5 and the interval L6 between the parasitic element arrays 6 in the antenna apparatus 100E of FIG. 11. It is noted that the frequency of the high-frequency signal to be fed to the dipole antenna 4C is set to 62 GHz. In addition, the length of the feed element 4*e* is set to be shorter than the length of the feed element 4*a* so as to direct radio waves from the dipole antenna 4C in the end-fire direction. Further, the width in the X-axis direction of the parasitic elements 5 is set to $\lambda/25$ and the length in the Y-axis direction of the parasitic elements 5 is set to about three times the width in the X-axis direction of the parasitic elements 5.

Figure 23:
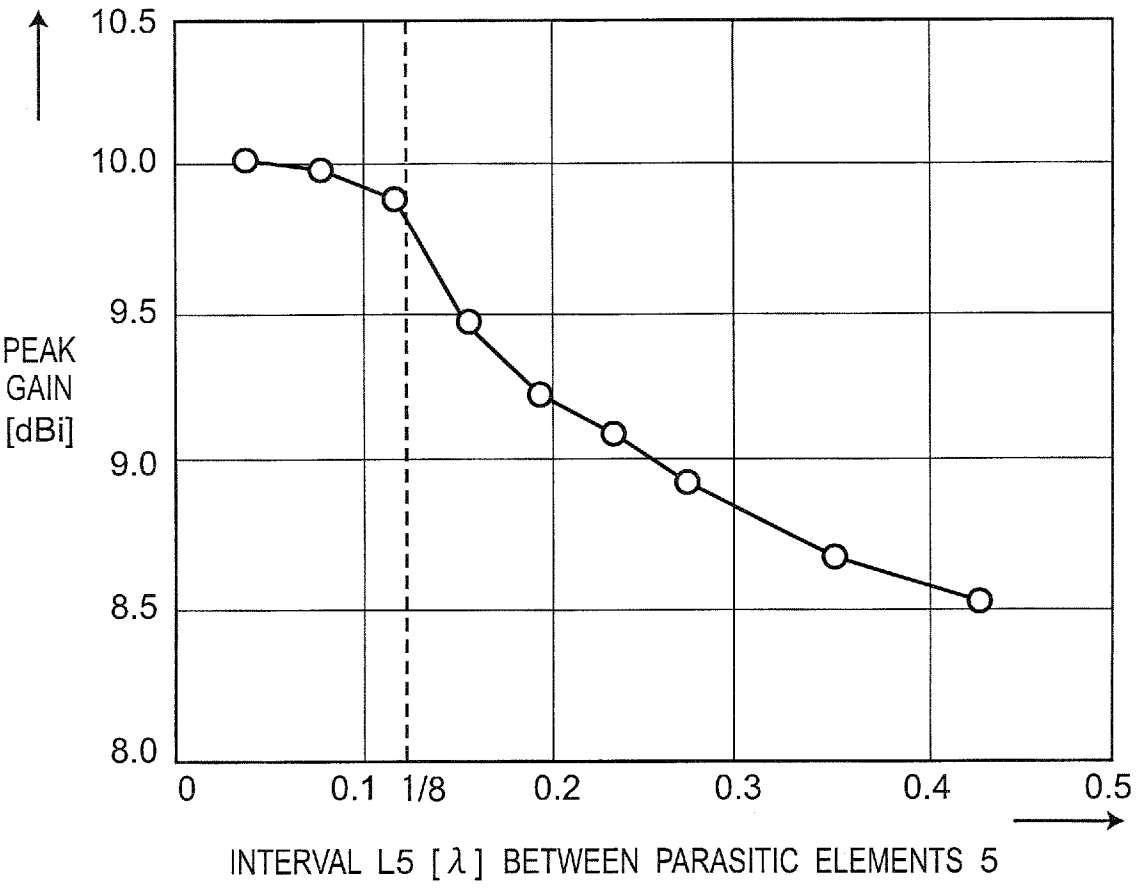
FIG. 23 is a graph showing a relationship between an interval L5 between the parasitic elements 5 and the peak gain of a main beam, when an interval L6 between the parasitic element arrays 6 is set to λ/10 in the antenna apparatus 100E of FIG. 11.
Figure 24:
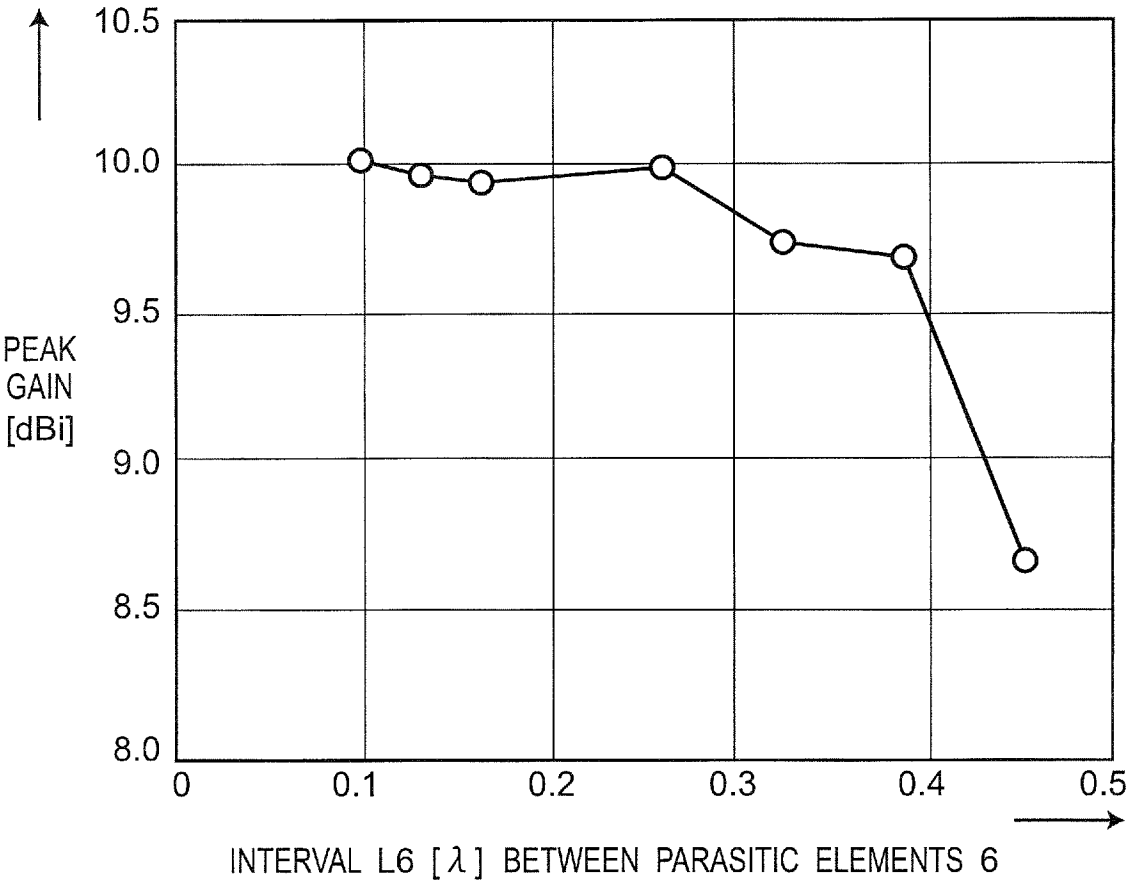
FIG. 24 is a graph showing a relationship between the interval L6 between the parasitic element arrays 6 and the peak gain of a main beam, when the interval L5 between the parasitic elements 5 is set to λ/25 in the antenna apparatus 100E of FIG. 11.

FIG. 23 is a graph showing a relationship between the interval L5 between the parasitic elements 5 and the peak gain of a main beam, when the interval L6 between the parasitic element arrays 6 is set to $\lambda/10$ in the antenna apparatus 100E of FIG. 11. As shown in FIG. 23, the smaller the interval L5 becomes, the higher the peak gain becomes. In particular, by setting the interval L5 to equal to or smaller than $8/\lambda$, a high peak gain of equal to or larger than 9.5 dBi can be obtained. In addition, FIG. 24 is a graph showing a relationship between the interval L6 between the parasitic element arrays 6 and the peak gain of a main beam, when the interval L5 between the parasitic elements 5 is set to $\lambda/25$ in the antenna apparatus 100E of FIG. 11. As shown in FIG. 24, the smaller the interval L6 becomes, the higher the peak gain becomes. In particular, by setting the interval L6 to equal to or smaller than $0.4\lambda$, a high peak gain of equal to or larger than 9.5 dBi can be obtained.

The parasitic element arrays 6, 61 to 67, and 8 are arranged at equal intervals in the above-described preferred embodiments and modified preferred embodiment, however, the present disclosure is not limited to this. The parasitic element arrays 6, 61 to 67 and 8 may be arranged at unequal intervals. It is noted, however, that the maximum value of the intervals between a plurality of parasitic elements is preferably equal to or smaller than 0.4λ. In addition, the parasitic element arrays 6, 61 to 67 and 8 are arranged linearly in the above-described preferred embodiments and modified preferred embodiment, however, the present disclosure is not limited to this. Each of the parasitic element arrays 6, 61 to 67 and 8 may be arranged along a curve. Further, in each of the parasitic element arrays 6, 61 to 67 and 8 in the above-described preferred embodiments and modified preferred embodiment, the parasitic elements 5 and 7 are arranged at equal intervals, however, the present disclosure is not limited to this. The parasitic elements 5 and 7 may be arranged at unequal intervals. It is noted, however, that the maximum value of the intervals between the parasitic elements 5 and 7 in each of the parasitic element arrays 6, 61 to 67 and 8 is preferably equal to or smaller than λ/8.

In addition, a grounded coplanar line is used as the feeder line 20 for transmitting high-frequency signals in the above-described preferred embodiments and modified preferred embodiment, however, the present disclosure is not limited to this. An unbalanced transmission line or balanced transmission line such as a microstrip line may be used as the feeder line 20.

The preferred embodiments for antenna apparatuses and a wireless communication apparatus according to the present disclosure have been described in detail above, however, the present disclosure is not limited to the above-described preferred embodiments. Various modifications and changes may be made without departing from the spirit and scope of the present disclosure.

INDUSTRIAL APPLICABILITY

As described above in detail, the antenna apparatus and wireless communication apparatus according to the present disclosure are configured to include at least three first parasitic element arrays each including a plurality of first parasitic elements formed on a first side of a dielectric substrate. In this case, in each of the first parasitic element arrays, each of the plurality of first parasitic elements has a strip shape substantially parallel to the longitudinal direction of the dipole antenna, and the plurality of first parasitic elements are arranged at the predetermined first intervals so as to be electromagnetically coupled to each other. The at least three first parasitic element arrays are arranged substantially parallel to one another at the predetermined second intervals so that the first pseudo-slot openings are formed between each pair of adjacent first parasitic element arrays. The first pseudo-slot openings allow the radio wave from the dipole antenna to propagate therethrough as the magnetic current. Therefore, it is possible to provide an antenna apparatus and a wireless communication apparatus each having a size smaller than that of the prior art and having gain characteristics higher than that of the prior art.

The antenna apparatuses and wireless communication apparatus according to the present disclosure are useful as antenna apparatuses and a wireless communication apparatus for the field of high-frequency communication, etc.

Although the present disclosure has been fully described in connection with the preferred embodiments thereof with reference to the accompanying drawings, it is to be noted that various changes and modifications are apparent to those skilled in the art. Such changes and modifications are to be understood as included within the scope of the present disclosure as defined by the appended claims unless they depart therefrom.

What is claimed is:

1. An antenna apparatus comprising:

a dielectric substrate having first and second surfaces;

a dipole antenna including a first feed element formed on the first surface of the dielectric substrate and connected to a feeder line, and a second feed element formed on the second surface of the dielectric substrate and connected to a ground conductor, the dipole antenna having an electrical length of substantially ½ of a wavelength of a high-frequency signal to be radiated; and at least three first parasitic element arrays, each of the first parasitic element arrays including a plurality of first parasitic elements formed on the first surface of the dielectric substrate, wherein, in each of the first parasitic element arrays, each of the plurality of first parasitic elements has a strip shape substantially parallel to a longitudinal direction of the dipole antenna, and the plurality of first parasitic elements being arranged at predetermined first intervals so as to be electromagnetically coupled to each other, and wherein the at least three first parasitic element arrays are arranged substantially parallel to one another at predetermined second intervals so that each of first pseudo-slot openings is formed between each pair of adjacent first parasitic element arrays, the first pseudo-slot openings allowing a radio wave from the dipole antenna to propagate therethrough as magnetic currents.

2. The antenna apparatus as claimed in claim 1, wherein the first interval is set to substantially equal to or smaller than ⅛ of the wavelength.

3. The antenna apparatus as claimed in claim 1, wherein each first parasitic element in one of the pair of adjacent first parasitic element arrays is opposed to a corresponding first parasitic element in another first parasitic element array at their respective adjacent ends.

4. The antenna apparatus as claimed in claim 1, wherein each first parasitic element in one of the pair of adjacent first parasitic element arrays is arranged so as to be shifted by a predetermined distance in a direction perpendicular to the longitudinal direction of the dipole antenna from a corresponding first parasitic element in another first parasitic element array.

5. The antenna apparatus as claimed claim 1, further comprising at least three second parasitic element arrays, each of the second parasitic element arrays including a plurality of second parasitic elements formed on the second surface of the dielectric substrate, wherein, in each of the second parasitic element arrays, each of the plurality of second parasitic elements has a strip shape substantially parallel to the longitudinal direction of the dipole antenna, and the plurality of second parasitic elements being arranged at predetermined third intervals so as to be electromagnetically coupled to each other, wherein the at least three second parasitic element arrays are arranged substantially parallel to one another at predetermined fourth intervals so that each of second pseudo-slot openings is formed between each pair of adjacent second parasitic element arrays, the second pseudo-slot openings allowing the radio wave from the dipole antenna to propagate therethrough as magnetic currents, and wherein the dipole antenna further includes:

a third parasitic element formed on the second surface so as to be opposed to the first feed element; and a fourth parasitic element formed on the first surface so as to be opposed to the second feed element.

6. The antenna apparatus as claimed in claim 5, wherein the third interval is set to substantially equal to or smaller than ⅛ of the wavelength.

7. The antenna apparatus as claimed in claim 1, wherein an electrical length of the first feed element and an electrical length of the second feed element are set to be different from each other.

8. The antenna apparatus as claimed in claim 1, wherein an electrical length of the first feed element and an electrical length of the second feed element are set to be substantially equal to each other.

9. The antenna apparatus as claimed in claim 1, further comprising at least one parasitic element pair, each of the at least one parasitic element pair includes two parasitic elements formed on at least one of the first and second surfaces and operates as a reflector, wherein each of the two parasitic elements has a strip shape and the two parasitic elements are formed in a straight line so as to be opposed to and be electromagnetically coupled to the dipole antenna, the straight line being parallel to the longitudinal direction of the dipole antenna and being located on an opposite side of the dipole antenna from the at least three first parasitic element arrays.

10. A wireless communication apparatus comprising an antenna apparatus, wherein the antenna apparatus comprises:

a dielectric substrate having first and second surfaces;

a dipole antenna including a first feed element formed on the first surface of the dielectric substrate and connected to a feeder line, and a second feed element formed on the second surface of the dielectric substrate and connected to a ground conductor, the dipole antenna having an electrical length of substantially ½ of a wavelength of a high-frequency signal to be radiated; and at least three first parasitic element arrays, each of the first parasitic element arrays including a plurality of first parasitic elements formed on the first surface of the dielectric substrate, wherein, in each of the first parasitic element arrays, each of the plurality of first parasitic elements has a strip shape substantially parallel to a longitudinal direction of the dipole antenna, and the plurality of first parasitic elements being arranged at predetermined first intervals so as to be electromagnetically coupled to each other, and wherein the at least three first parasitic element arrays are arranged substantially parallel to one another at predetermined second intervals so that each of first pseudo-slot openings is foamed between each pair of adjacent first parasitic element arrays, the first pseudo-slot openings allowing a radio wave from the dipole antenna to propagate therethrough as magnetic currents.

* * * * *